US006016945A

United States Patent [19]

Phillips et al.

[11] Patent Number: 6,016,945

[45] Date of Patent: Jan. 25, 2000

[54] INTERNAL COMBUSTION FASTENER DRIVING TOOL MANUAL RECYCLER

[75] Inventors: Alan Phillips; John Schnell, both of Jackson, Tenn.

[73] Assignee: Porter-Cable Corporation, Jackson, Tenn.

[21] Appl. No.: 09/001,797

[22] Filed: Dec. 31, 1997

[51] Int. Cl.[7] ..... B25C 1/04

[52] U.S. Cl. ..... 227/10; 227/130; 123/465 C

[58] Field of Search ..... 227/8, 9, 10, 130; 60/632, 633; 123/465 C

[56] References Cited

U.S. PATENT DOCUMENTS

| | | | |
|---|---|---|---|
| 4,405,072 | 9/1983 | Kindle et al. | 227/10 |
| 4,712,379 | 12/1987 | Adams et al. | 60/632 |
| 4,913,331 | 4/1990 | Utsumi et al. | 227/10 |
| 5,090,606 | 2/1992 | Tori et al. | 123/46 SC |
| 5,191,861 | 3/1993 | Kellerman et al. | 227/10 |
| 5,680,980 | 10/1997 | Robinson | 227/10 |

*Primary Examiner*—Scott A. Smith
*Attorney, Agent, or Firm*—Merchant & Gould P.C.

[57] ABSTRACT

The present invention relates to a fastener driving tool operable through an internal combustion driven piston. The stool includes a pump system having an intake system, an exhaust system, a pump sleeve, a pump housing, and a piston housing. The pump sleeve sealably contacts the piston housing and defines the space around the piston housing. The pump housing is arranged and configured to axially in the space and to sealably contact the pump sleeve. A pump compression spring in the space axially biases the pump housing. The intake system is arranged and configured for fluid communication with the combustion chamber. The exhaust system is arranged and configured for fluid communication with the space. The tool can also include a linear cam system and fuel valve; a fuel metering system; and/or a trigger.

34 Claims, 28 Drawing Sheets

INTERNAL COMBUSTION FASTENER DRIVING TOOL MANUAL RECYCLER

BACKGROUND AND SUMMARY OF THE INVENTION

The present invention relates to an internal combustion fastener driving tool including a handle system that is coupled to and supports a drive system, a magazine, and a nose piece. The fastener driving system is operable through an internal combustion driven piston. The drive system includes a driver body which includes a piston housing in which a piston is slideably housed. A driving member is coupled to the piston. A combustion chamber is defined by the driver body, piston housing, and piston. The piston and driving member are axially arranged and configured within the piston housing to drive a fastener upon combustion of a metered amount of gaseous fuel in the combustion chamber.

A manual recycler for a detonating impact tool has been described in U.S. Pat. No. 4,712,379. An improved fastener driving system includes an improved manual recycler. The preferred manual recycler includes a pump system. The pump system includes an intake system, an exhaust system, a pump sleeve, a pump housing, and a piston housing. The pump sleeve sealably contacts the piston housing and defines a space around the piston housing. The pump housing is arranged and configured to move axially in the space that is defined by the pump sleeve. The pump housing moves along an axis of the pump sleeve and/or an axis of the pump housing. A compression spring axially biases the pump housing to extend from the space defined by the pump sleeve. In the preferred pump system, the intake system is arranged and configured for fluid communication with the combustion chamber and the exhaust system is arranged and configured for fluid communication with the defined space.

A preferred improved manual recycler includes one or more additional features not found in prior art manual recyclers. In a preferred embodiment, the manual recycler includes a linear cam system and a fuel valve. The linear cam system is arranged and configured to activate the fuel valve when the pump housing is compressed into the space. The fuel valve is arranged and configured to dispense a metered amount of gaseous fuel into the combustion chamber when activated.

In another embodiment the fastener driving system includes a preferred manual recycler that works in conjunction with a fuel metering system, which is arranged and configured to provide a metered amount of gaseous fuel. A preferred fuel metering system includes a port for receiving gaseous fuel that is defined by the tool, a regulator that is in fluid communication with the port, and a shuttle valve. A preferred shuttle valve includes a metering chamber housing, a metering chamber defined by the metering chamber housing, a combustion check valve, and one gating valve. The metering chamber and gating valve are arranged and configured to provide a synchronous fluid communication between the metering chamber and combustion chamber, or between the metering chamber and the regulator. The combustion check valve is arranged and configured to prevent fluid flow from the combustion chamber to the metering chamber.

In another preferred embodiment, the improved manual recycler works in conjunction with a trigger, which, preferably, is coupled to the pump system. The trigger is arranged and configured to activate an ignition circuit when the pump housing is compressed into the space and the trigger is actuated.

DETAILED DESCRIPTION OF THE PREFERRED EMBODIMENT

Figure 1:
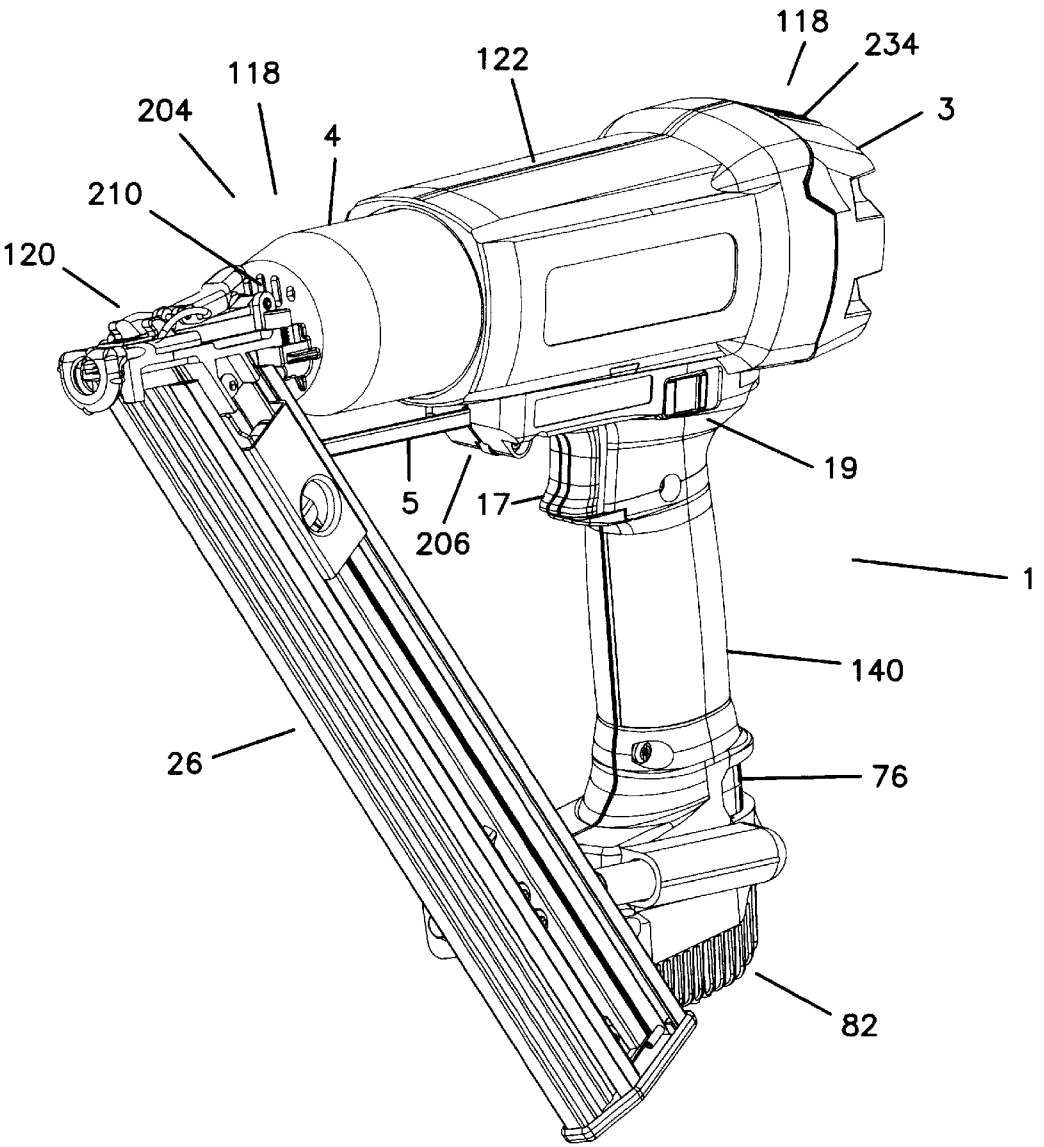
FIG. 1 shows a front right perspective view of a preferred embodiment of the present fastener driving system.
Figure 2:
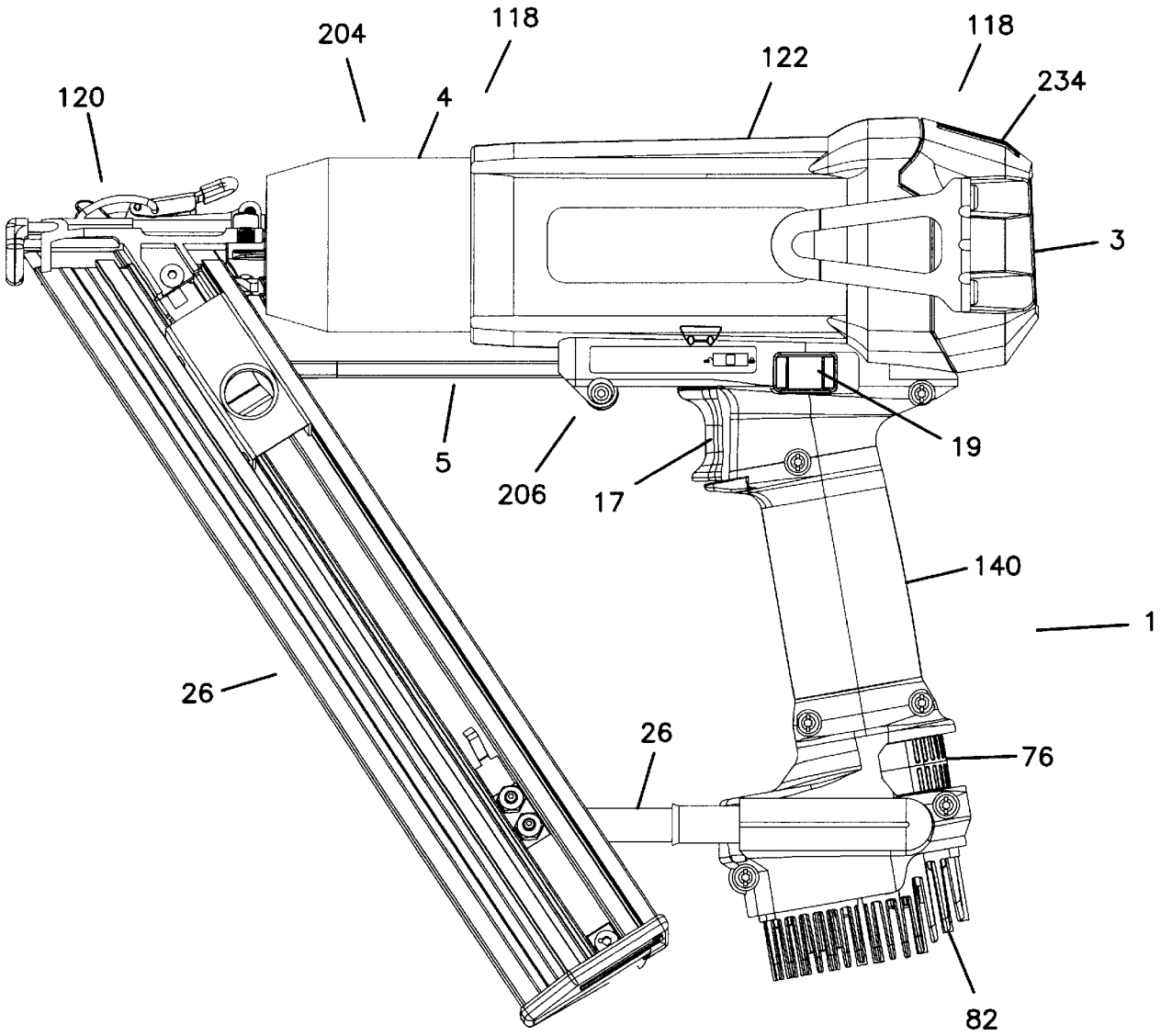
FIG. 2 illustrates a right side elevational view of the fastener driving tool shown in FIG. 1.
Figure 4:
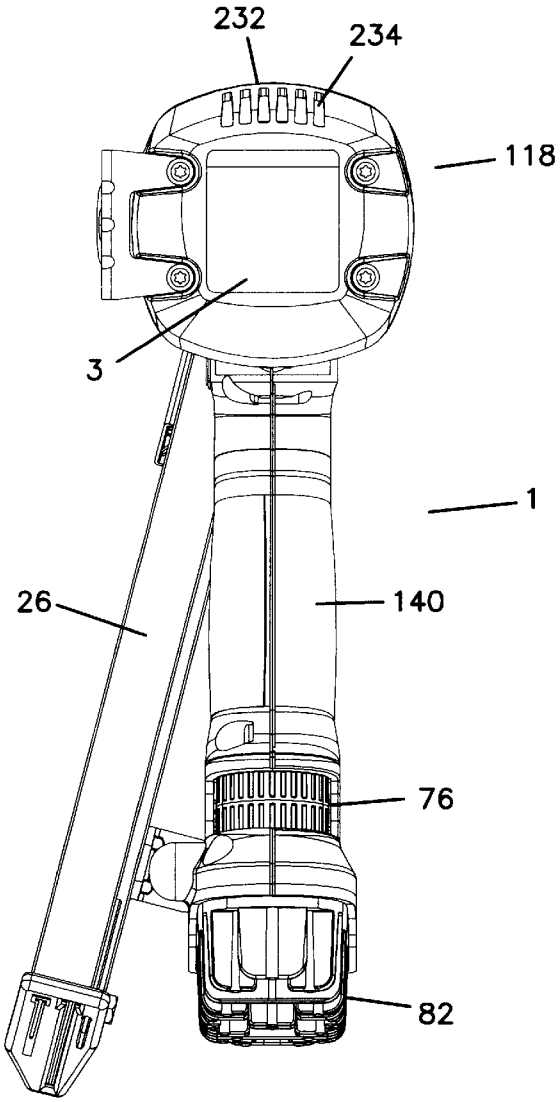
FIG. 4 shows a rear elevational view of the fastener driving tool shown in FIG. 1.
Figure 3:
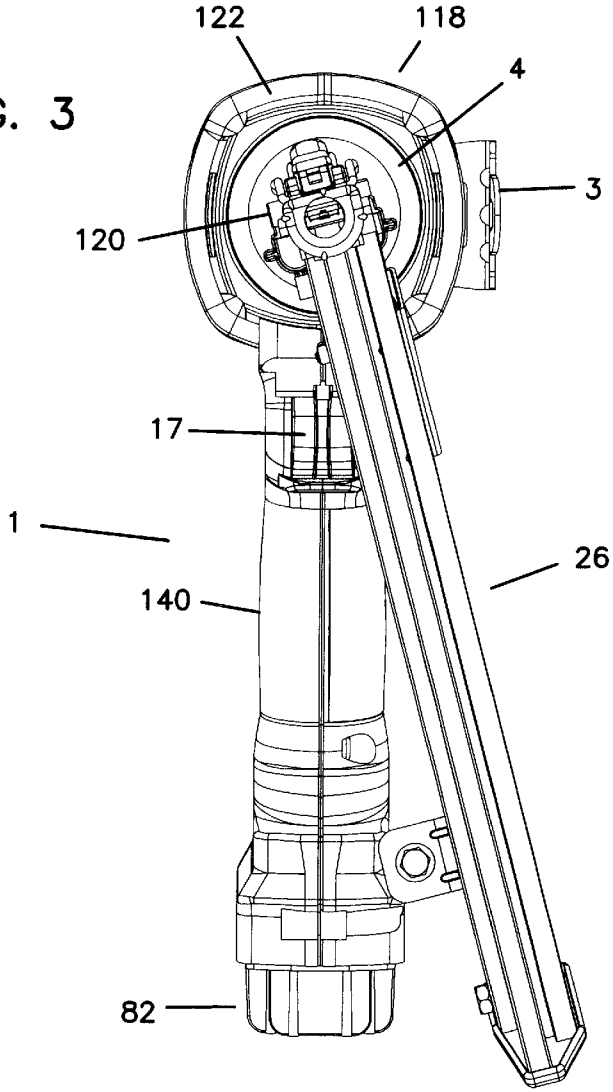
FIG. 3 shows a front elevational view of the fastener driving tool shown in FIG. 1.
Figure 5:
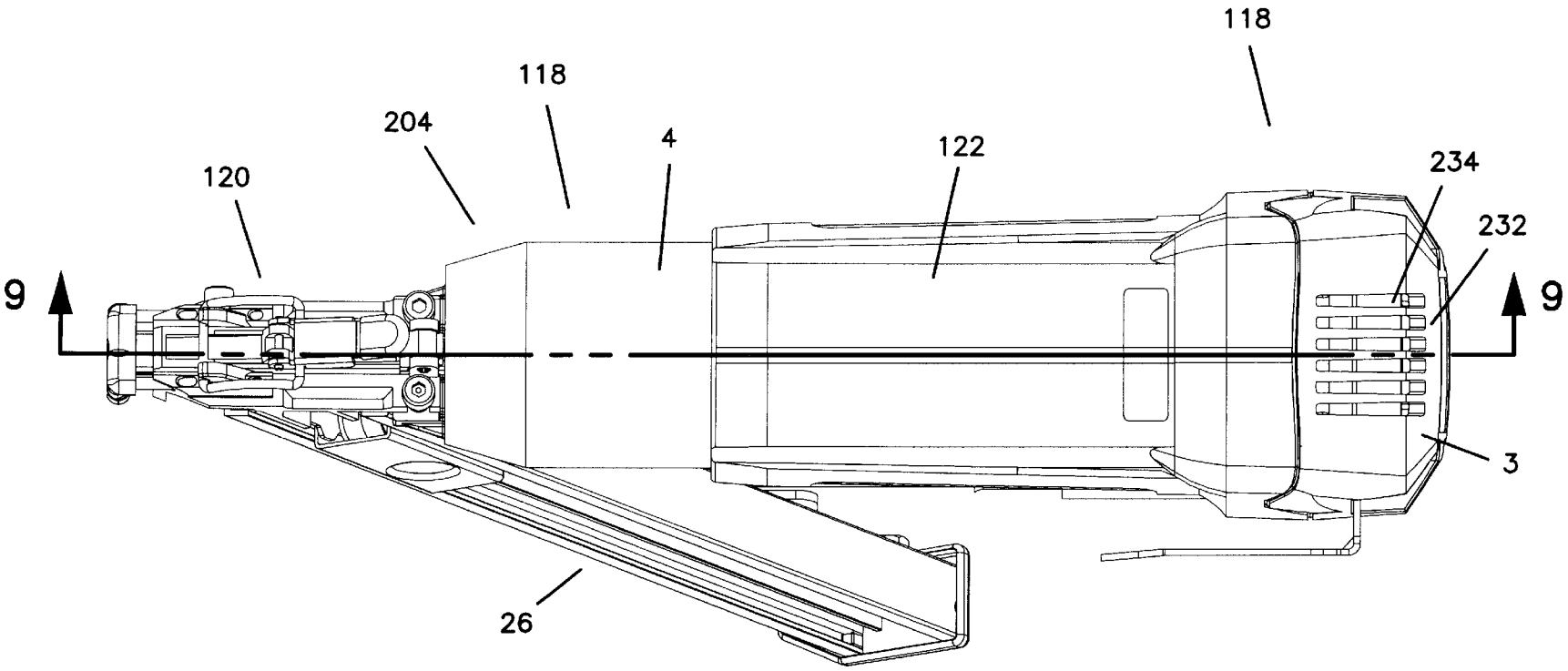
FIG. 5 shows a top plan view of the fastener driving tool shown in FIG. 1.
Figure 6:
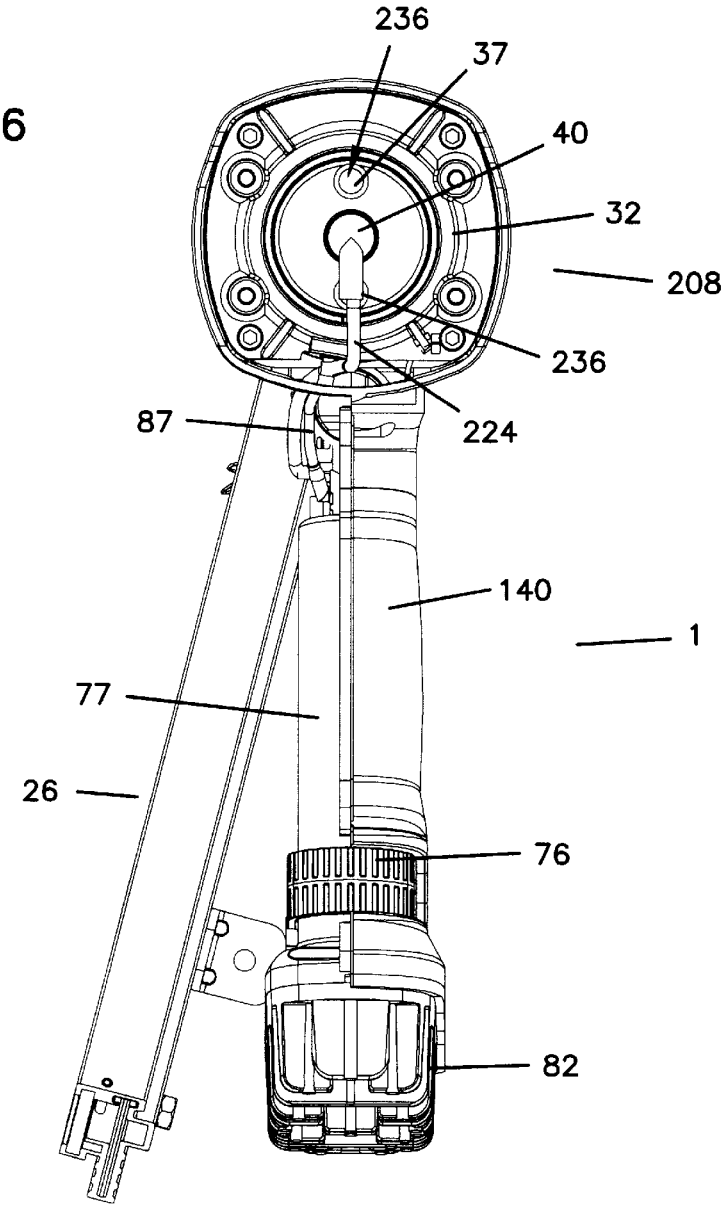
FIG. 6 shows a rear elevational view of the fastener driving tool shown in FIG. I with driver body end cap removed.
Figure 14:
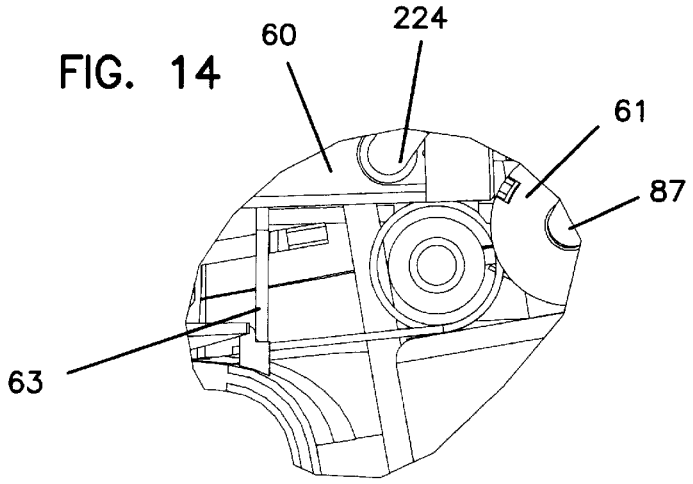
FIG. 14 illustrates a detail of FIG. 8.
Figure 7:
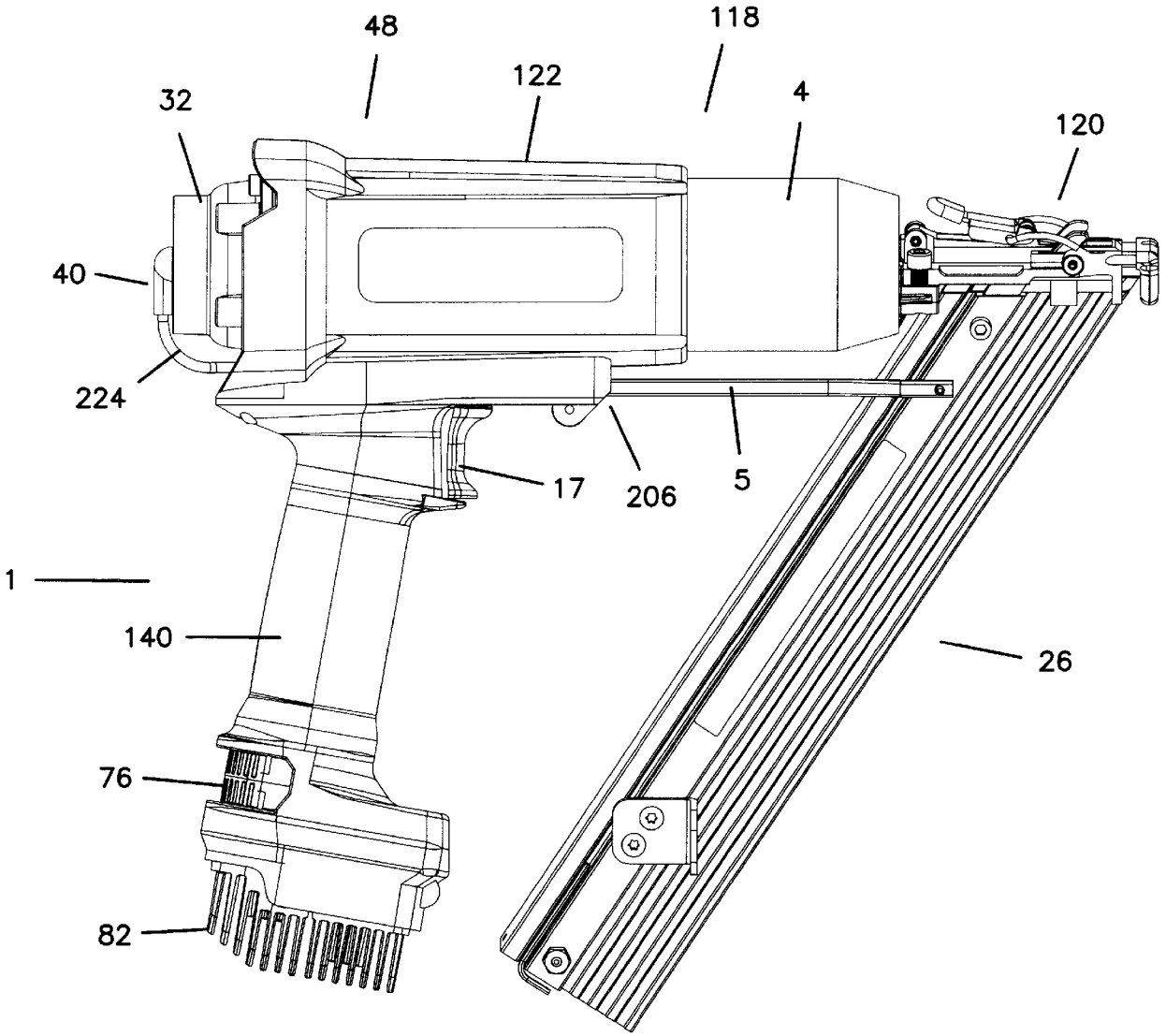
FIG. 7 shows a left side elevational view of the fastener driving tool shown in FIG. 1 with driver body end cap removed.
Figure 8:
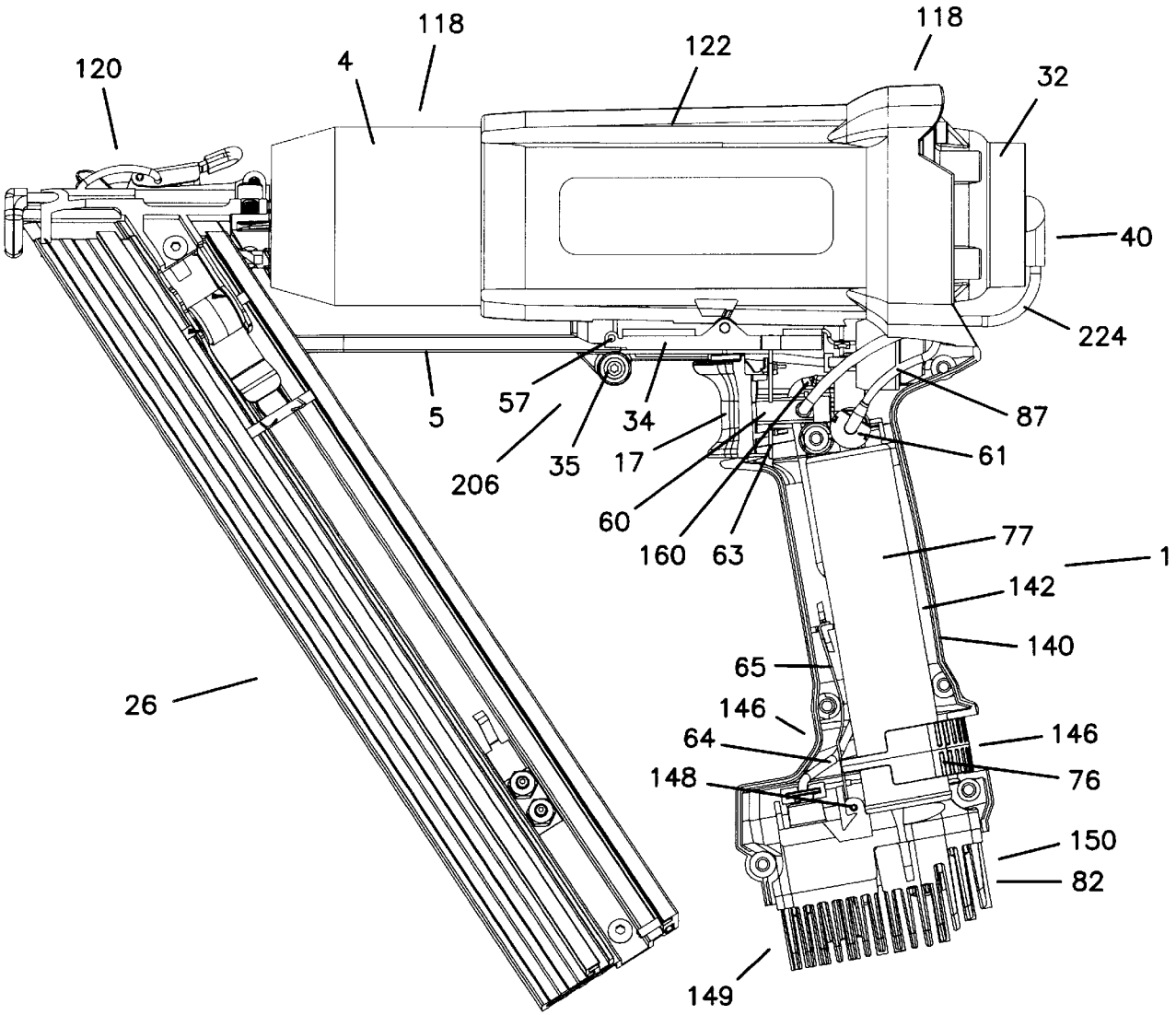
FIG. 8 shows a right side elevational view of the fastener driving tool shown in FIG. 1 with driver body end cap with right handle cover removed.
Figure 9:
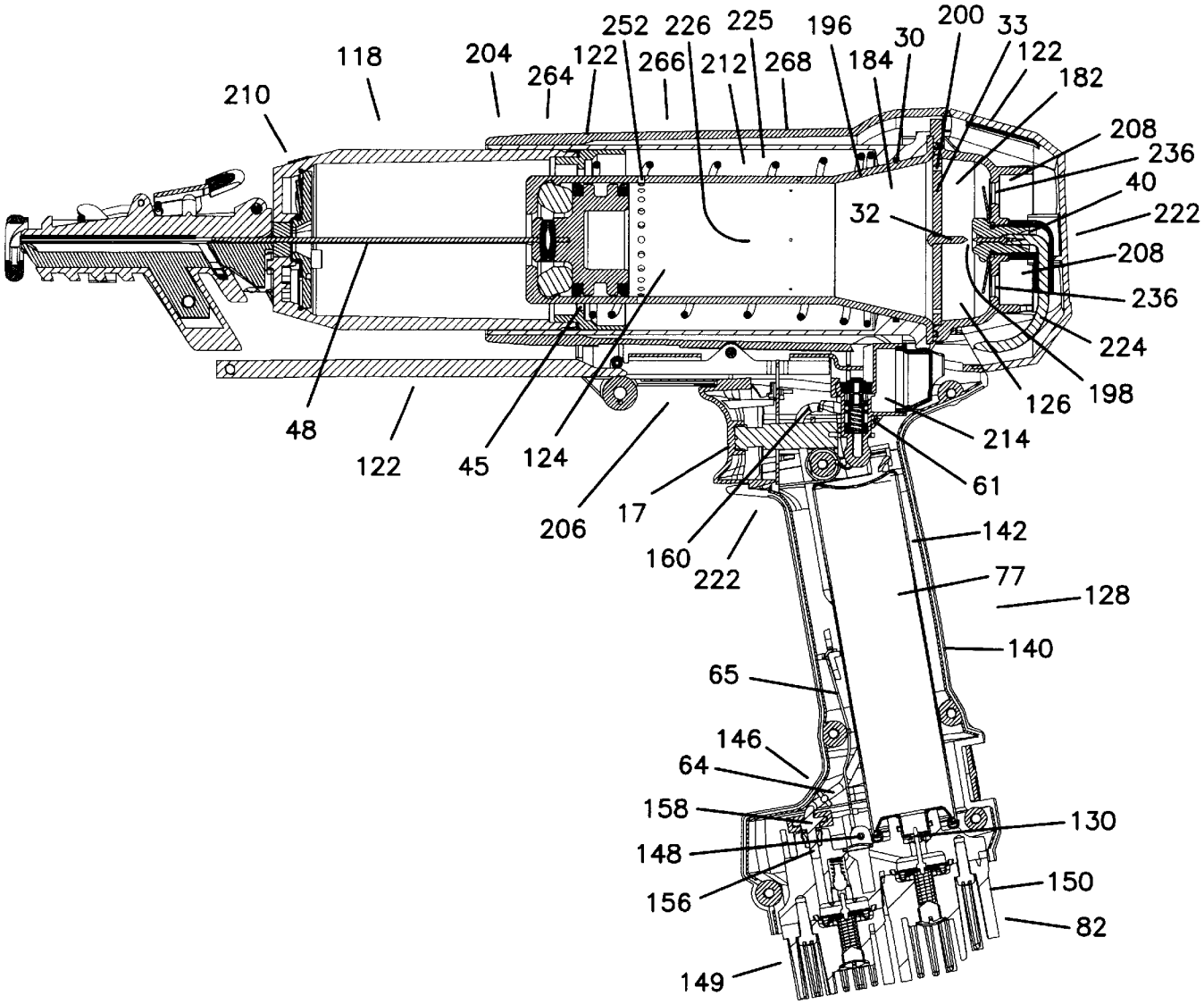
FIG. 9 shows a right elevational cross-sectional profile (taken along cutting line 9—9 of FIG. 5) illustrating the fastener driving tool shown in FIG. 1.
Figure 10:
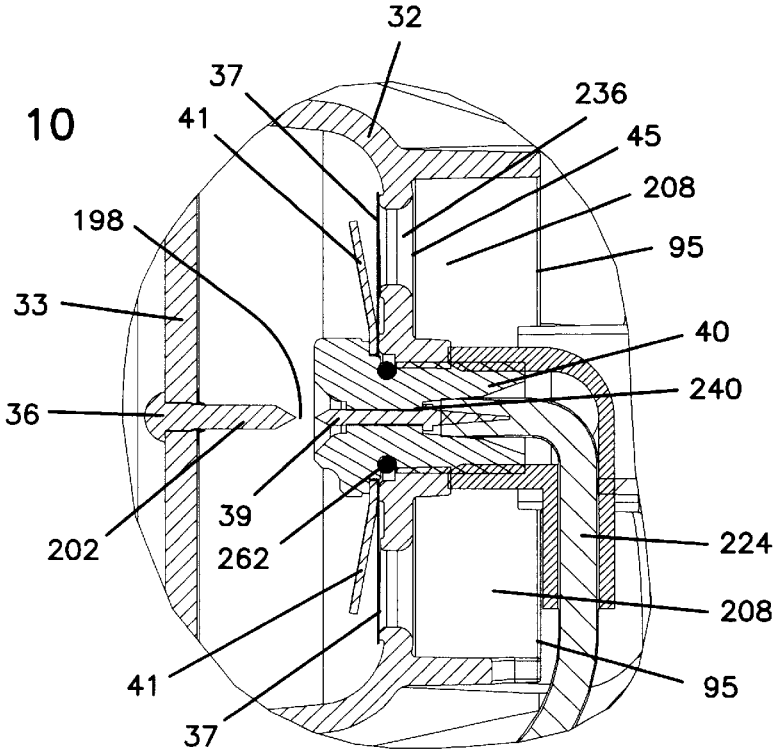
FIG. 10 shows a detail from FIG. 9 including a portion of a cylinder head and accelerator plate.
Figure 11:
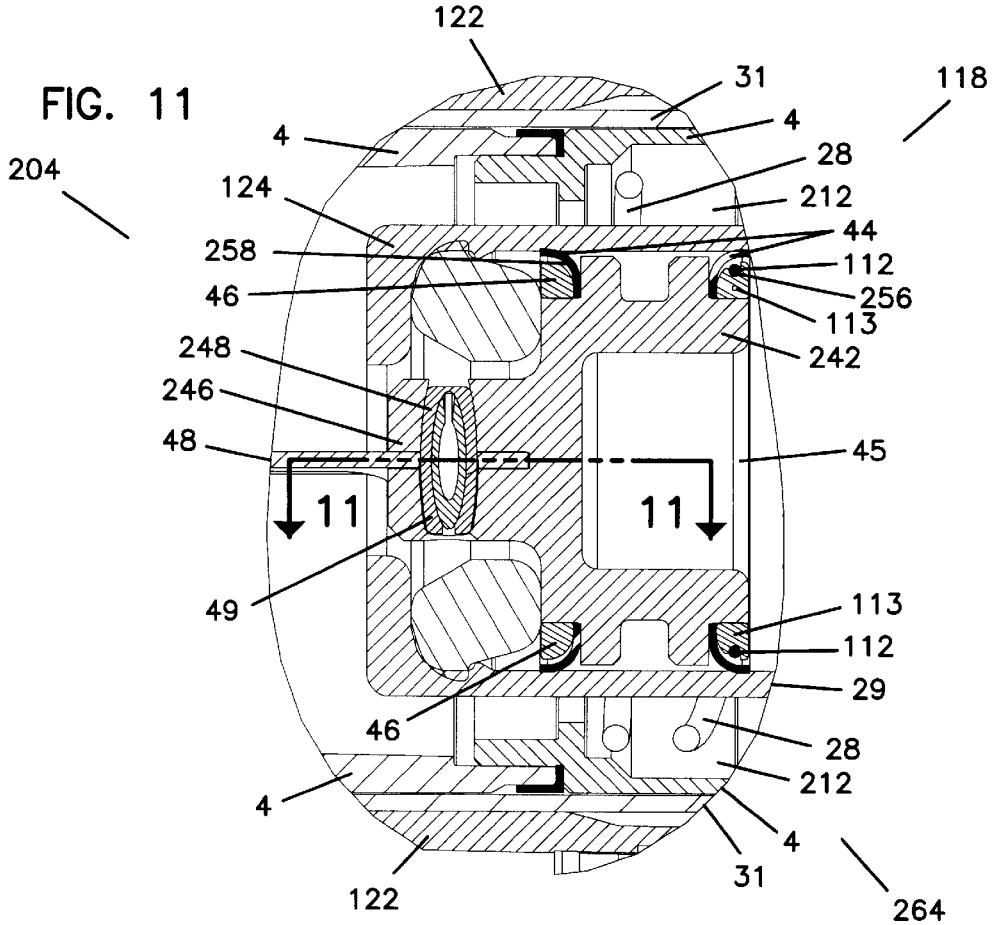
FIG. 11 shows a detail from FIG. 9 including the piston body.
Figure 12:
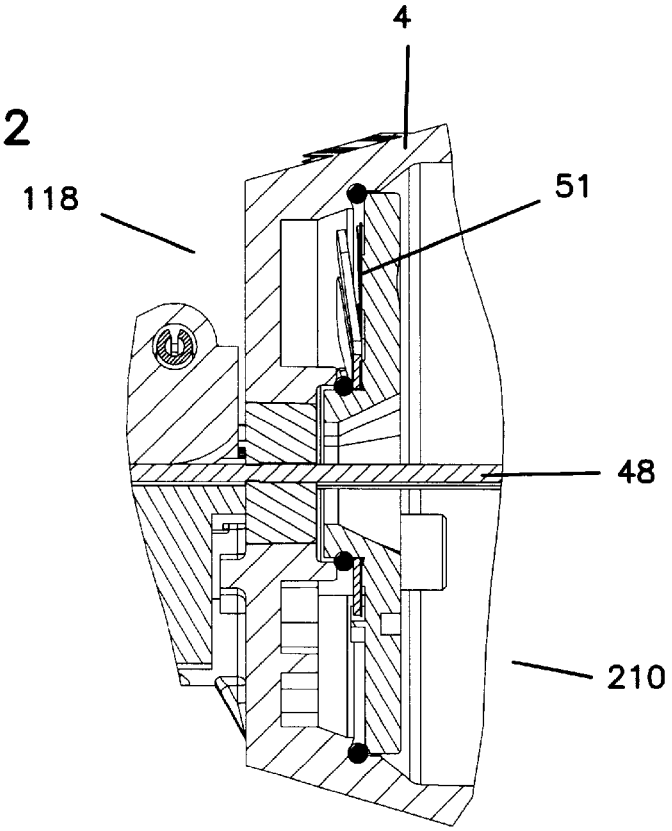
FIG. 12 shows a detail from FIG. 9 including an exhaust valve.
Figure 13:
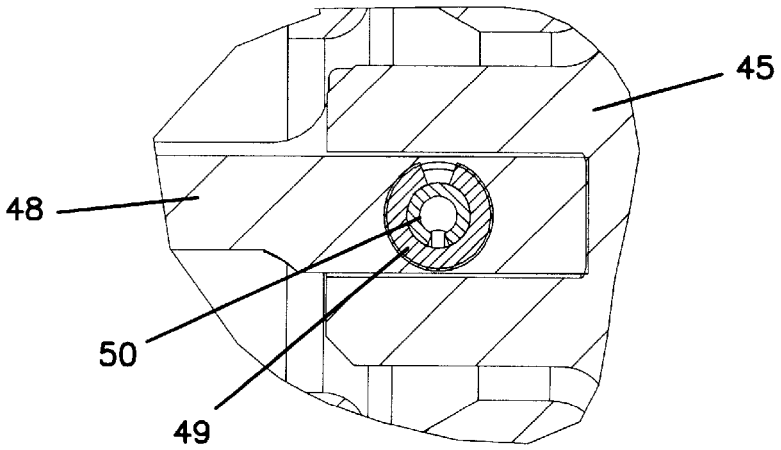
FIG. 13 shows a cross-sectional profile taken along cutting line 11—11 of FIG. 11 and illustrating coupling of a driving member to piston body.
Figure 16:
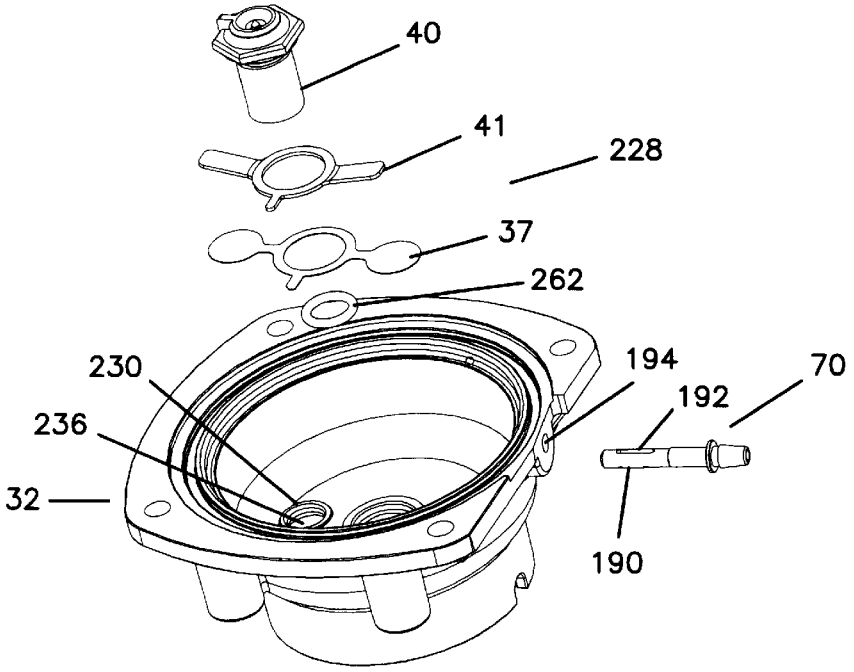
FIG. 16 is an exploded view of a portion of the fastener driving tool shown in FIG. 1 and illustrating features including fuel metering tube, air intake valve, spark plug, and cylinder head.
Figure 17:
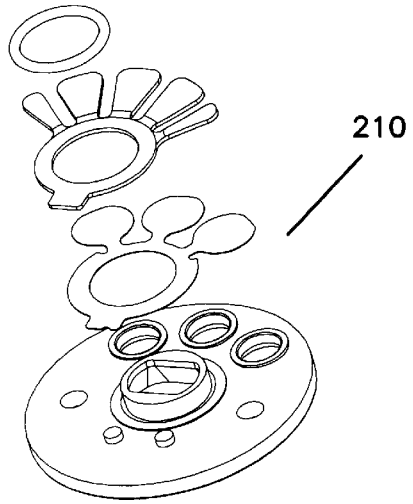
FIG. 17 illustrates an exploded view of a portion of the fastener driving tool shown in FIG. I and illustrating an exhaust valve.
Figure 15:
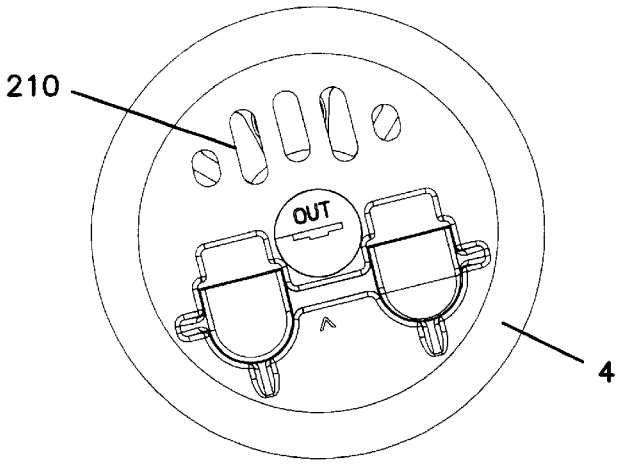
FIG. 15 is a rear view of piston body end cap of the fastener driving tool shown in FIG. 1.
Figure 18:
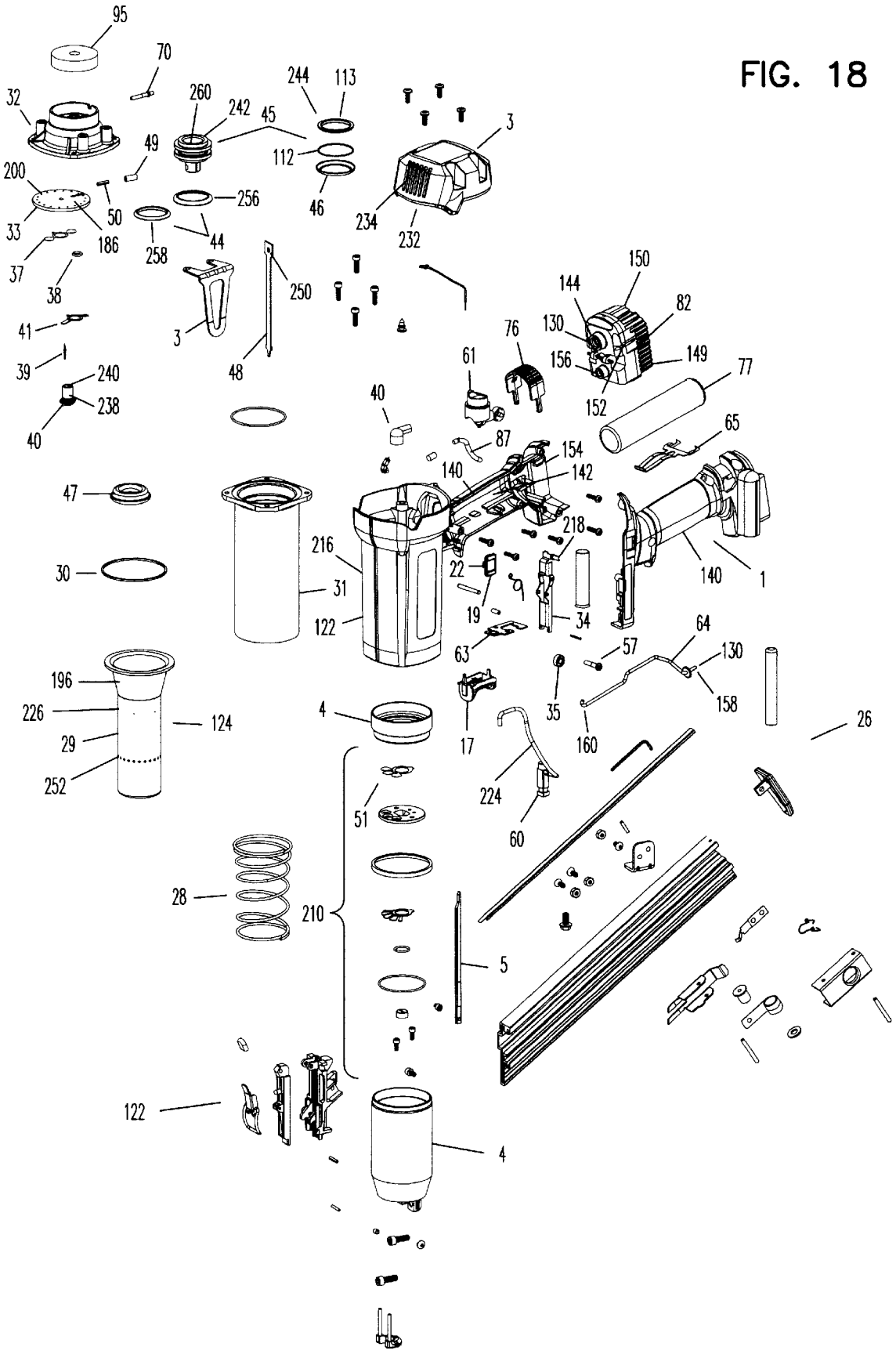
FIG. 18 illustrates an exploded view of the fastener driving tool shown in FIG. 1.
Figure 19:
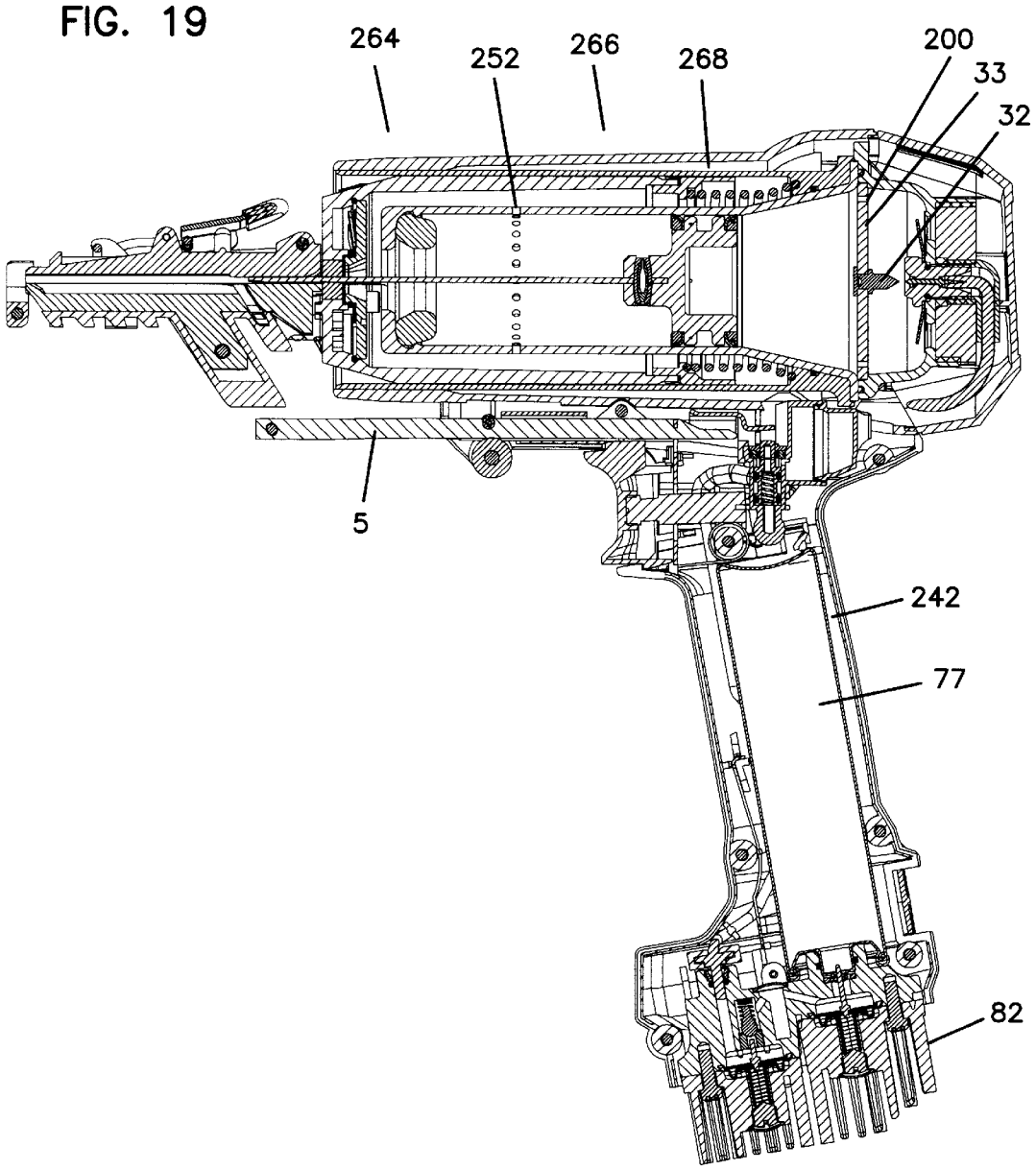
FIG. 19 shows a view of the fastener driving tool shown in FIG. 1 compressed against an object or workpiece.
Figure 20:
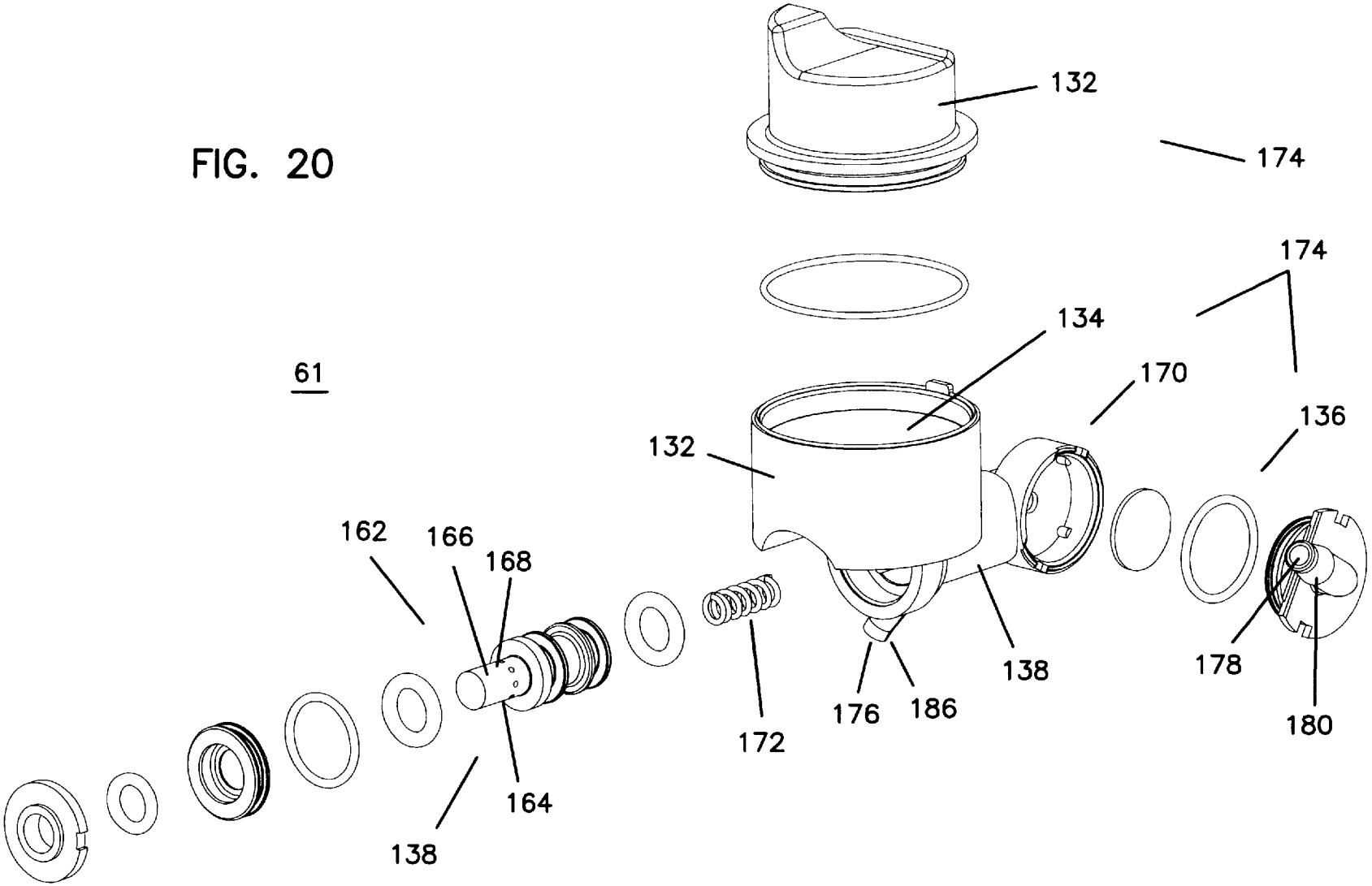
FIG. 20 illustrates an exploded view of a preferred embodiment of a shuttle valve employed in a preferred embodiment of a fastener driving tool shown in FIG. 1.
Figure 21:
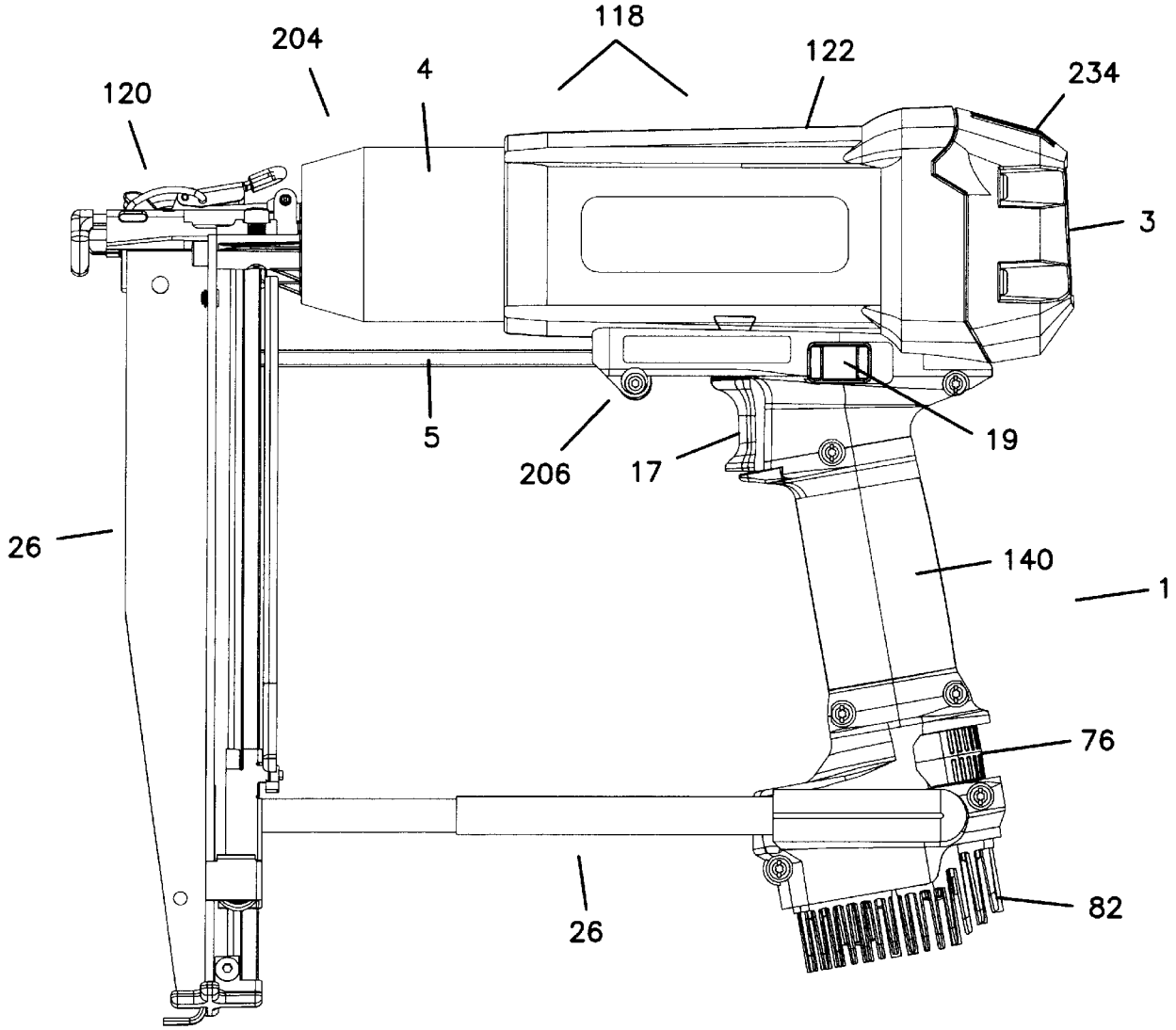
FIG. 21 is a right elevational view of a first embodiment of an internal combustion fastener driver of the invention.
Figure 22:
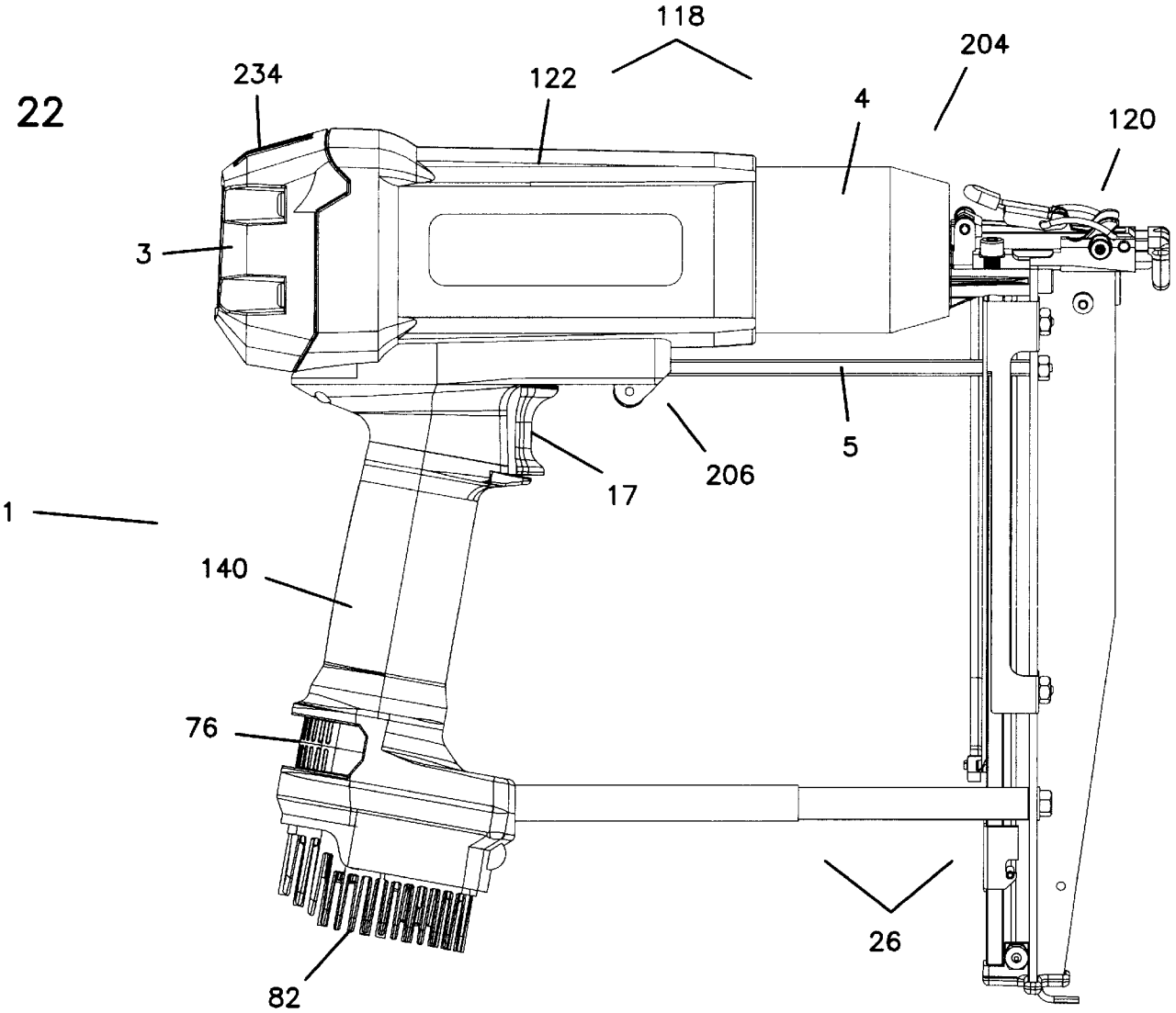
FIG. 22 is a left elevational view.
Figure 23:
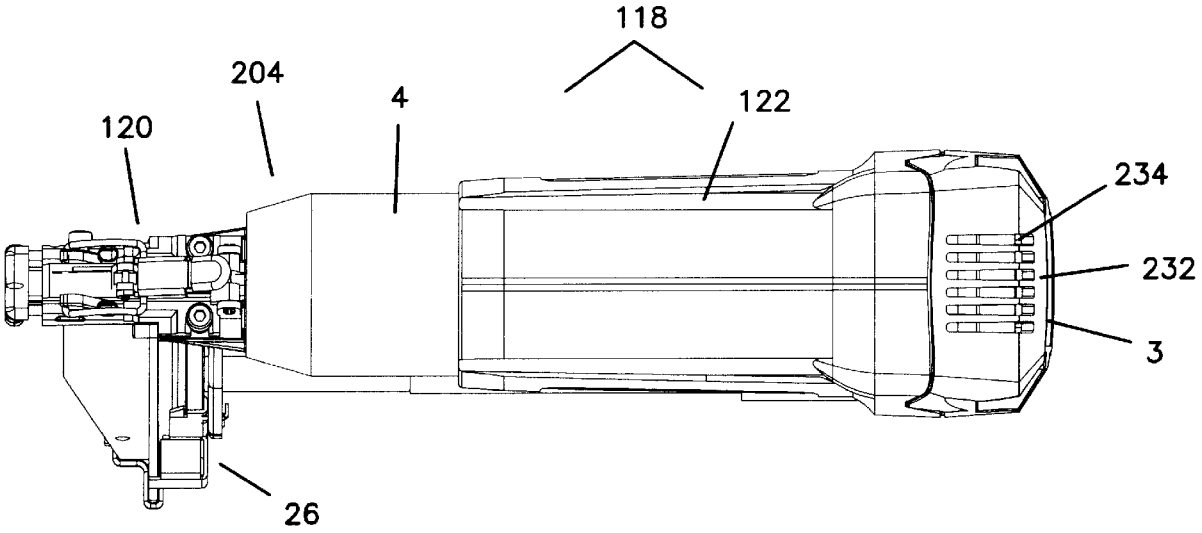
FIG. 23 is a top plan view.
Figure 24:
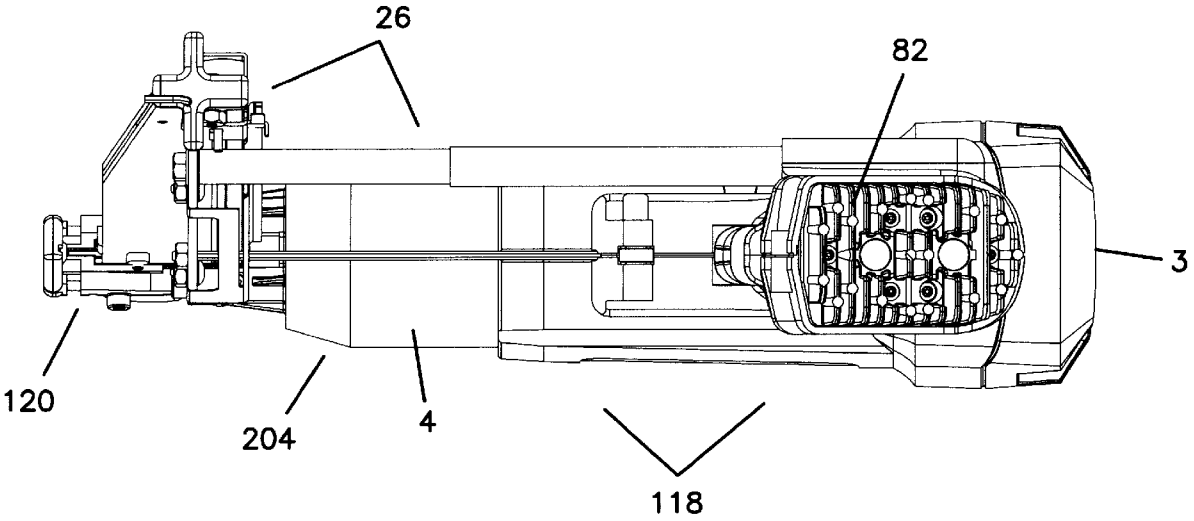
FIG. 24 is a bottom plan view.
Figure 26:
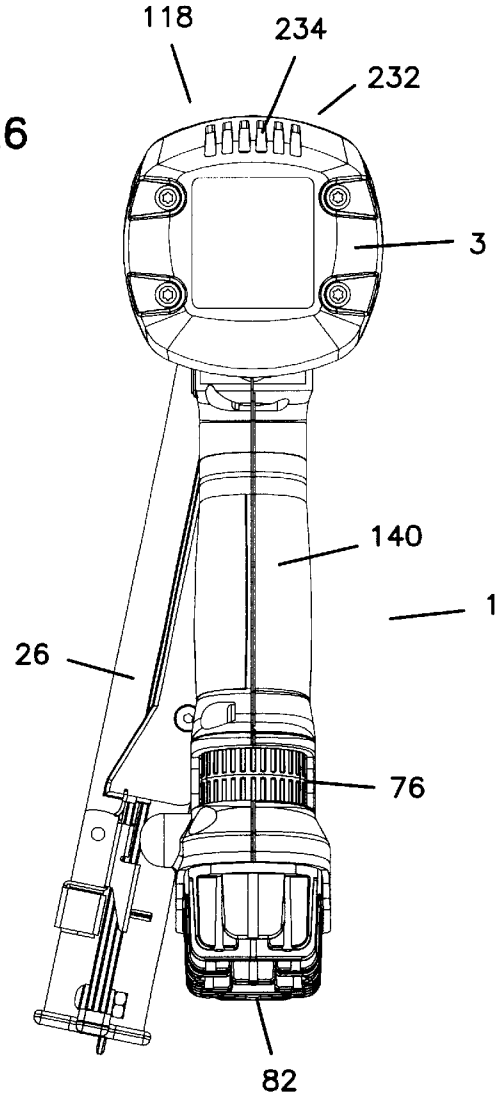
FIG. 26 is a rear elevational view.
Figure 25:
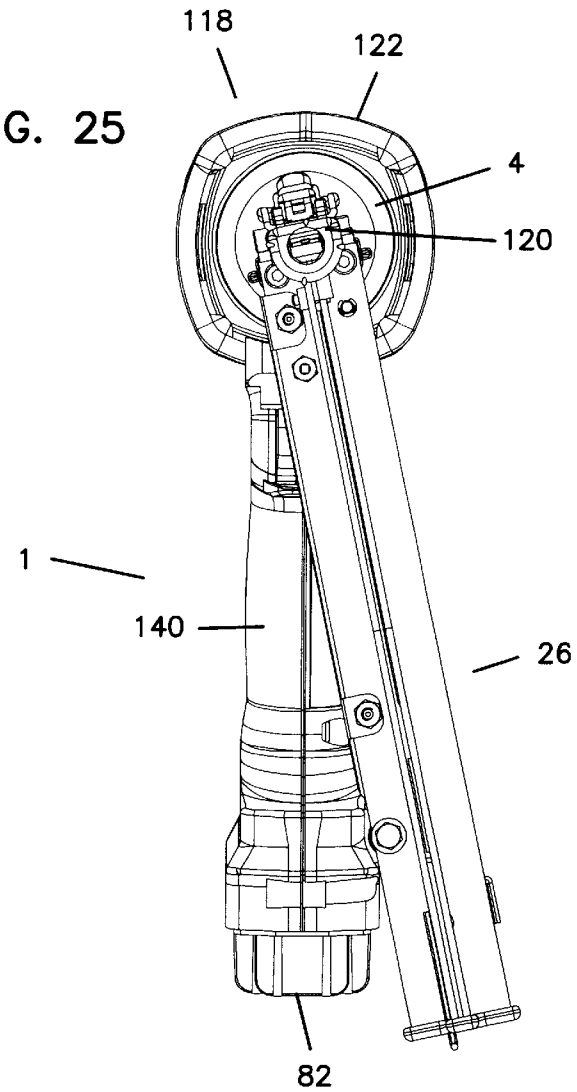
FIG. 25 is a front elevational view.
Figure 27:
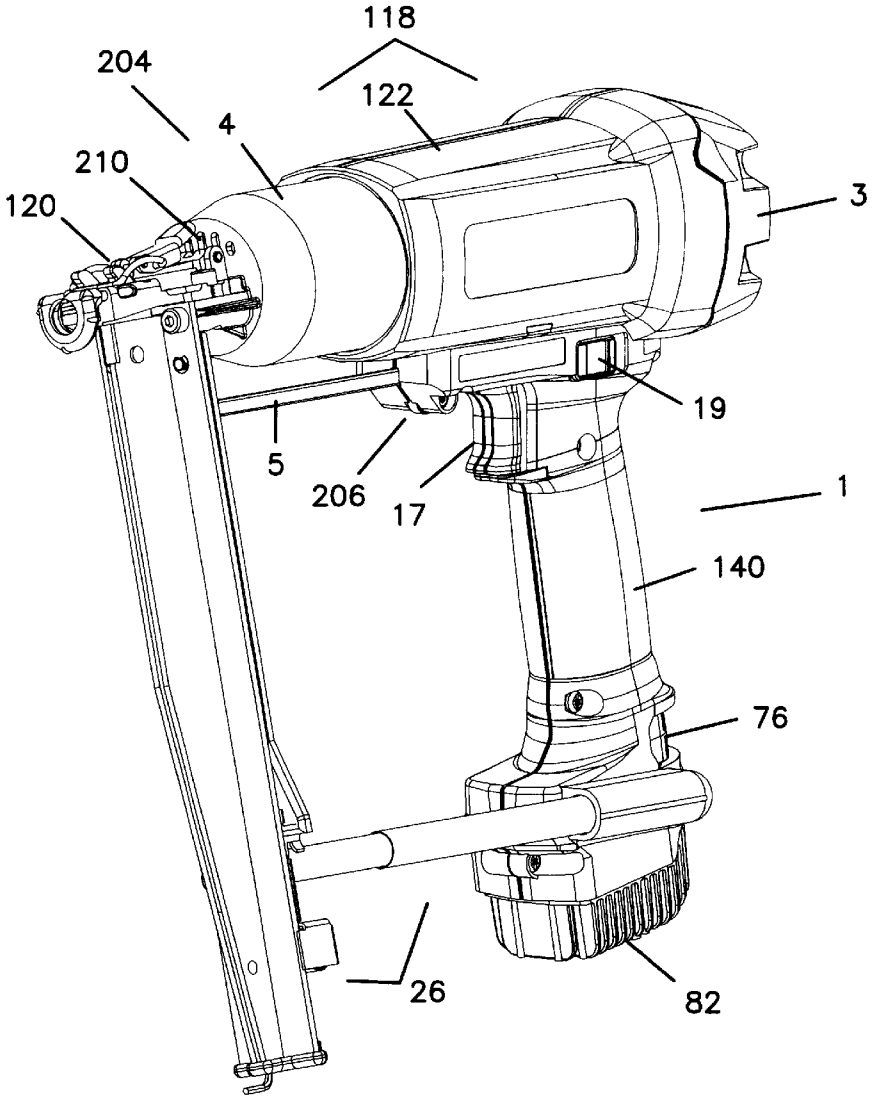
FIG. 27 is a top right perspective view.
Figure 28:
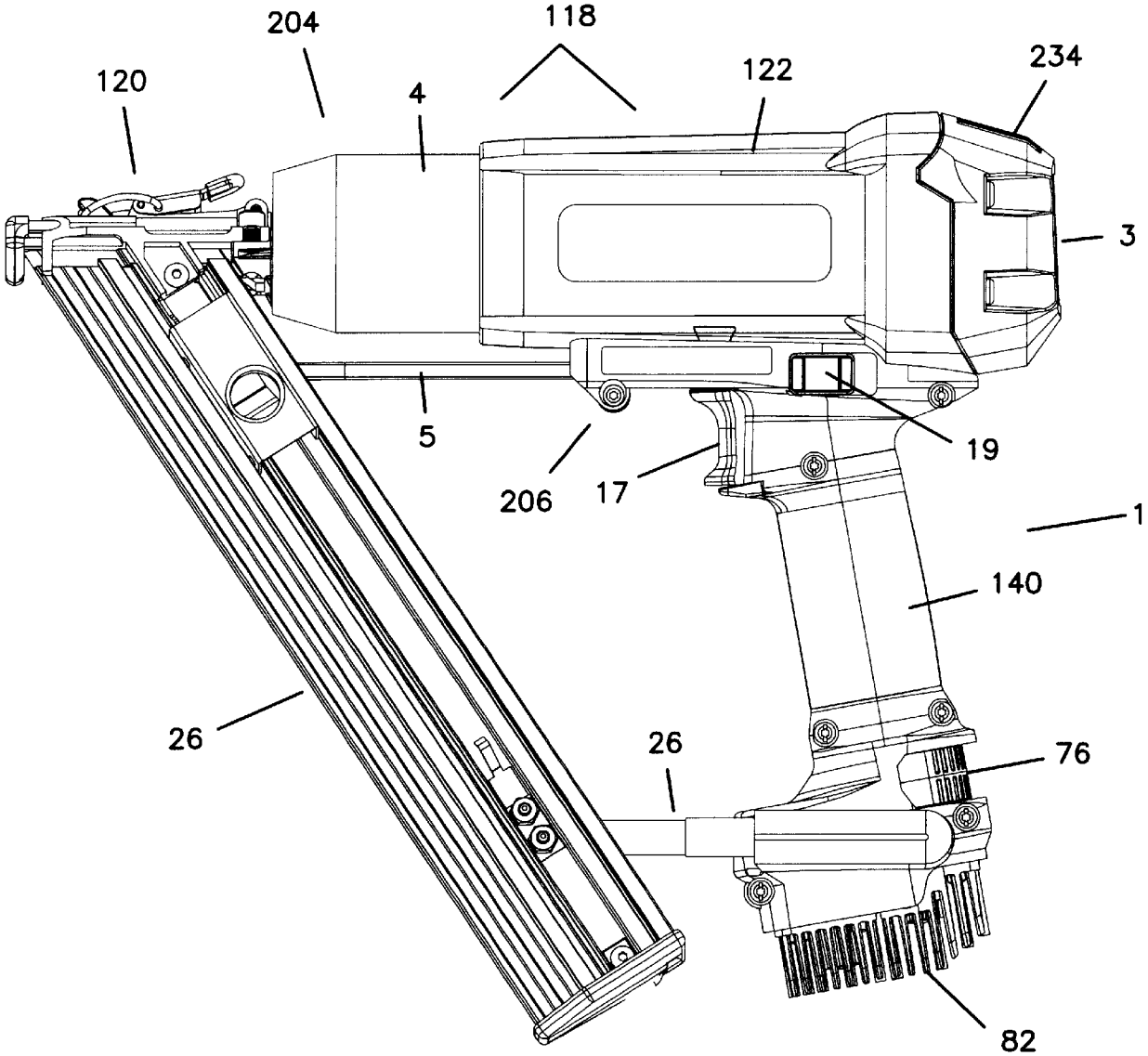
FIG. 28 is a right elevational view of a second embodiment of an internal combustion fastener driver of the invention.
Figure 29:
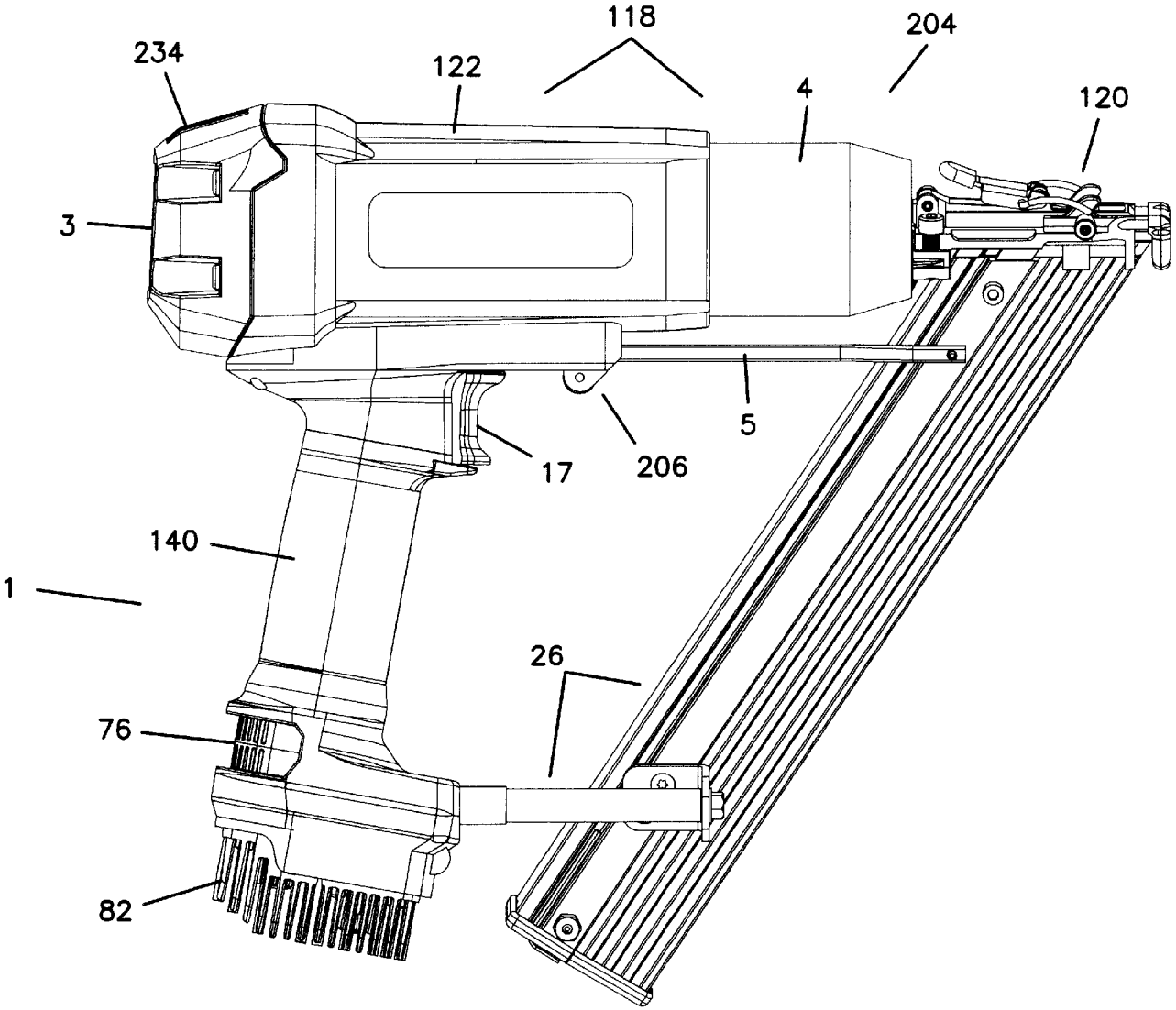
FIG. 29 is a left elevational view.
Figure 30:
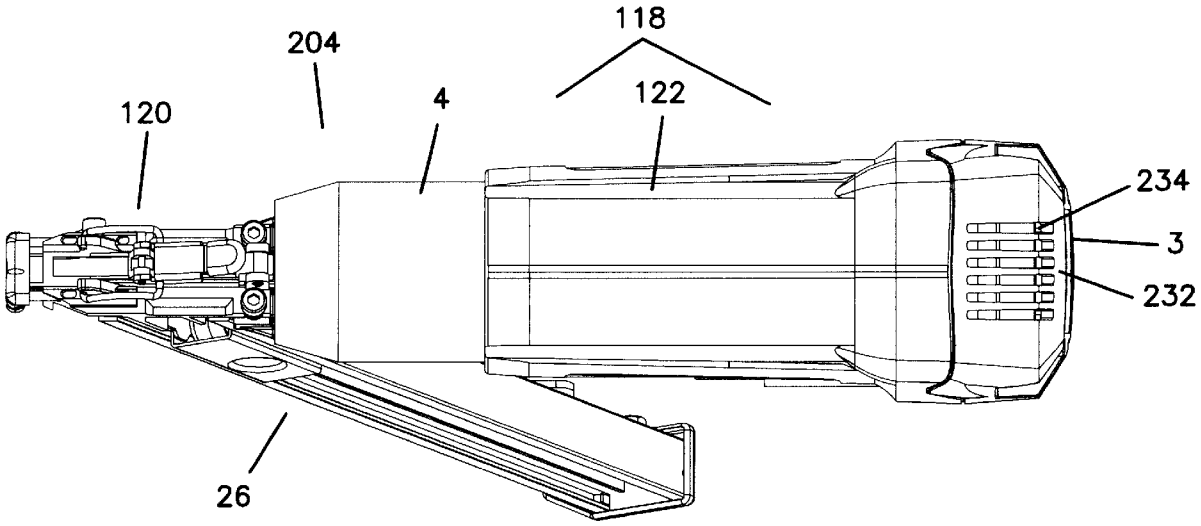
FIG. 30 is a top plan view.
Figure 31:
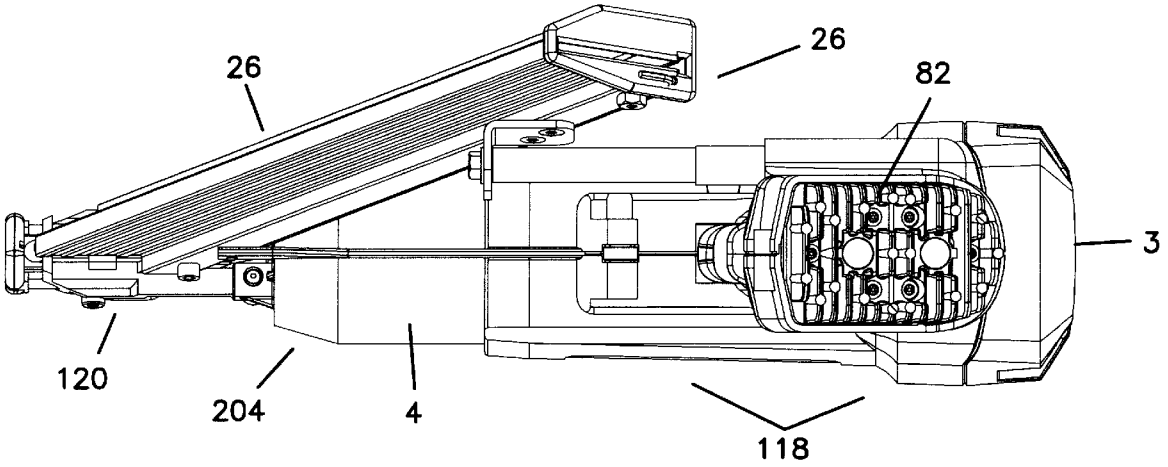
FIG. 31 is a bottom plan view.
Figure 33:
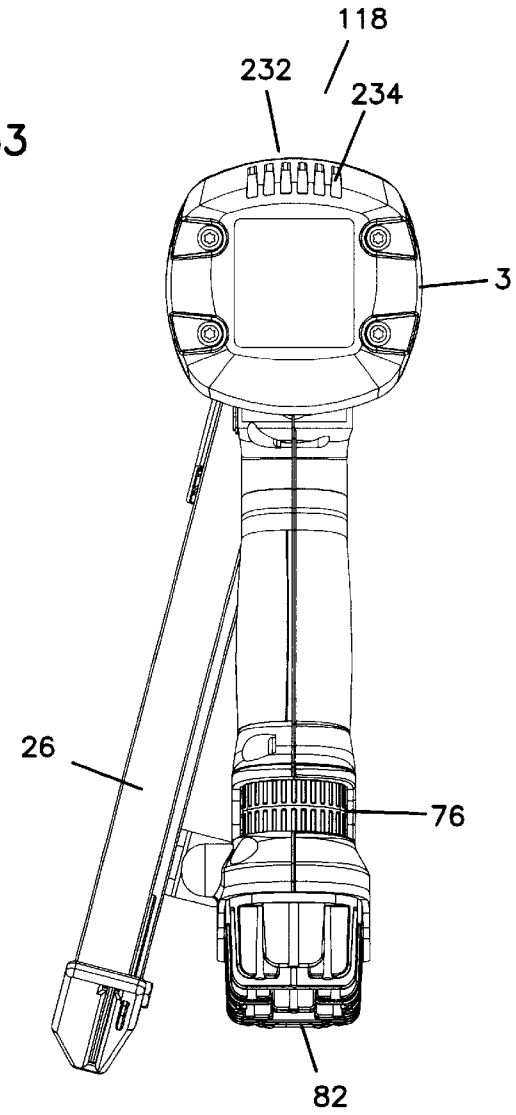
FIG. 33 is a rear elevational view.
Figure 32:
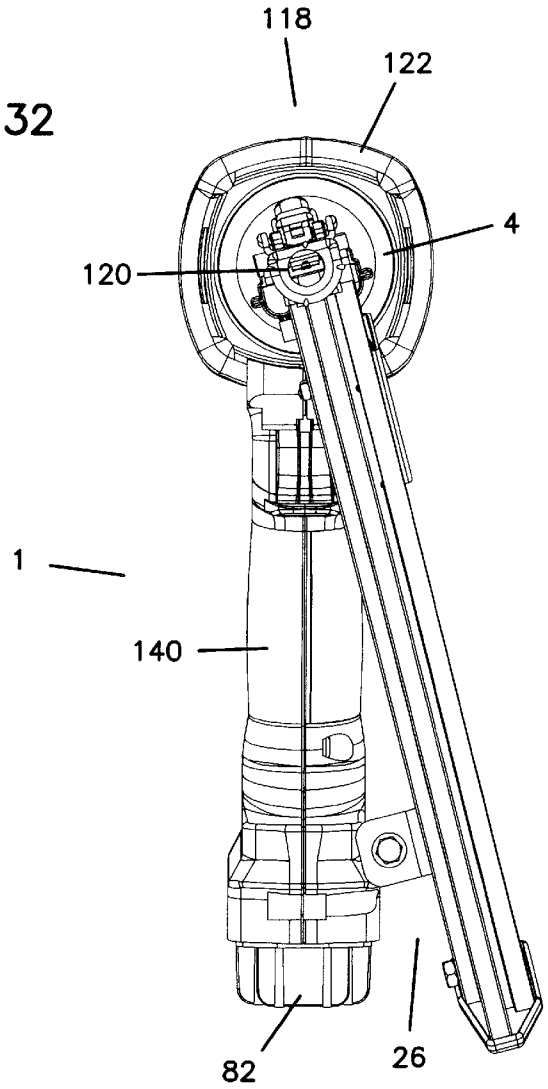
FIG. 32 is a front elevational view.
Figure 34:
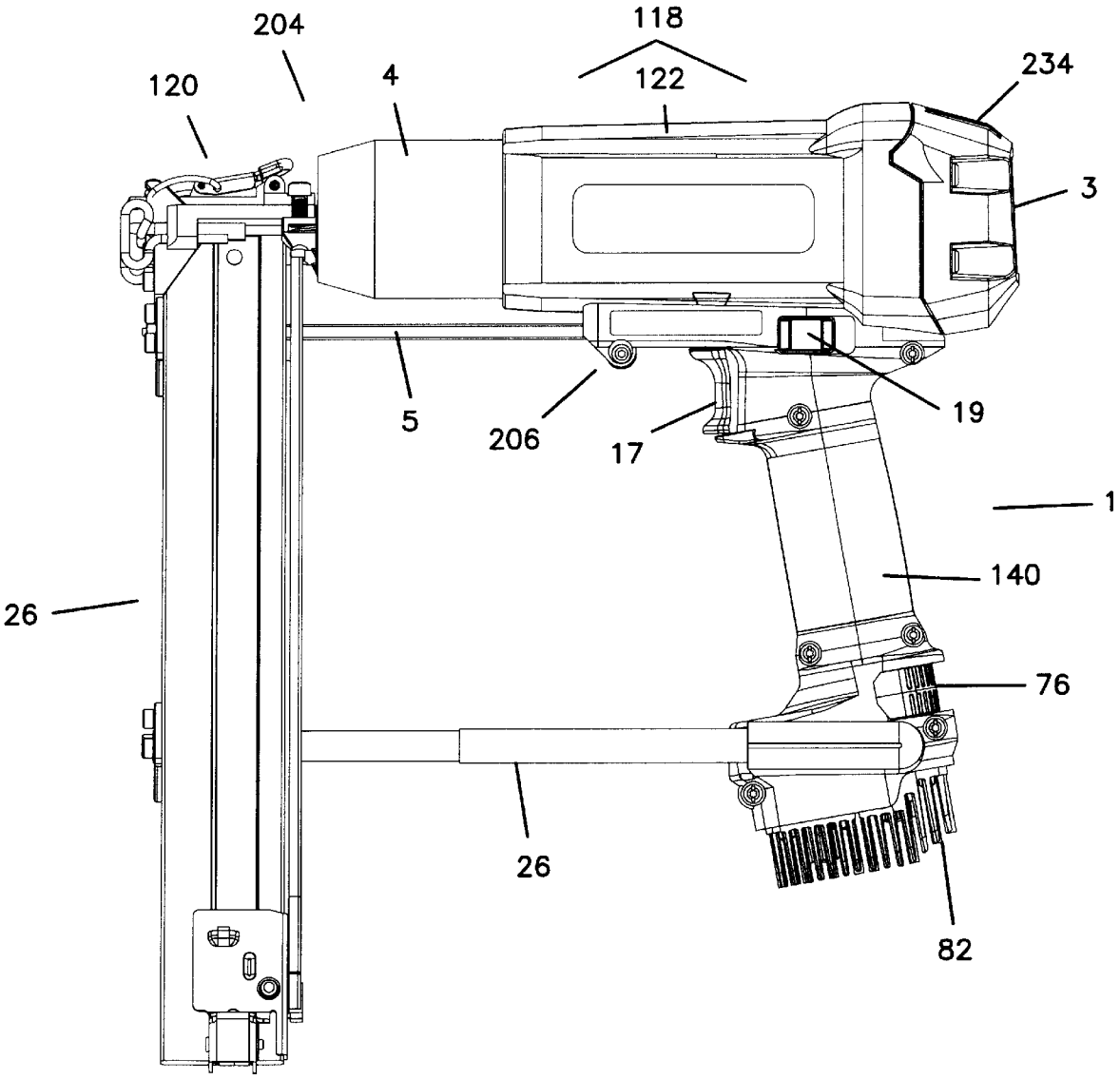
FIG. 34 is a right elevational view of a third embodiment of an internal combustion fastener driver of the invention.
Figure 35:
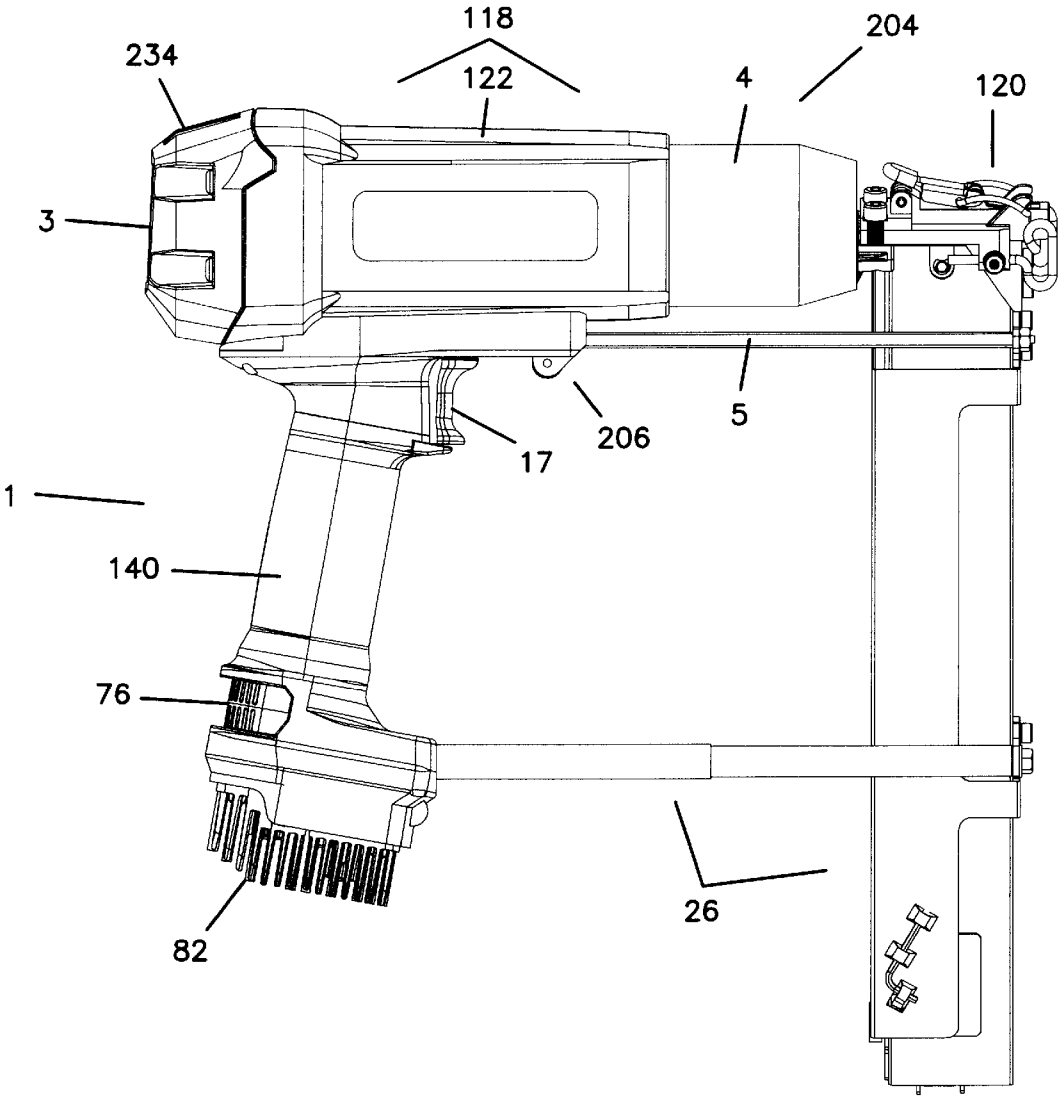
FIG. 35 is a left elevational view.
Figure 36:
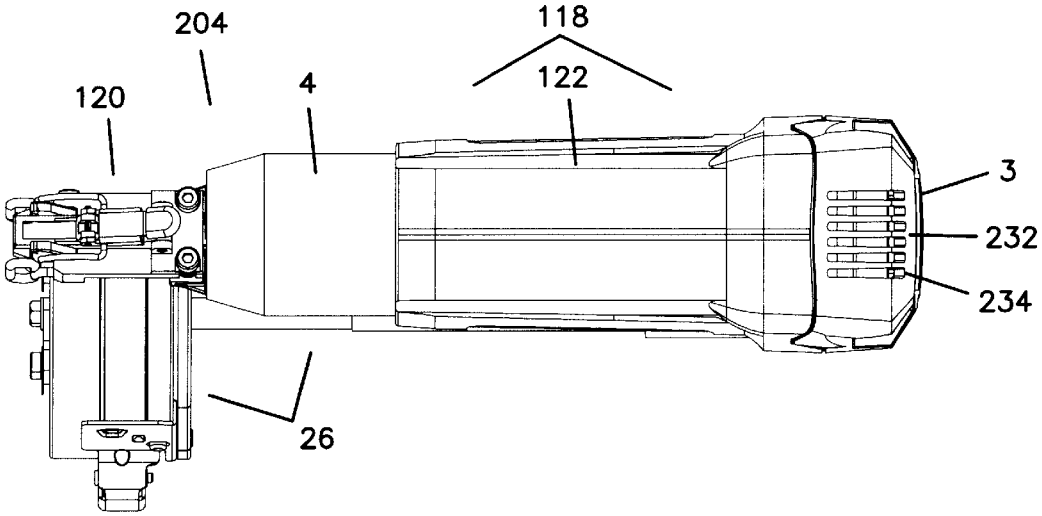
FIG. 36 is a top plan view.
Figure 37:
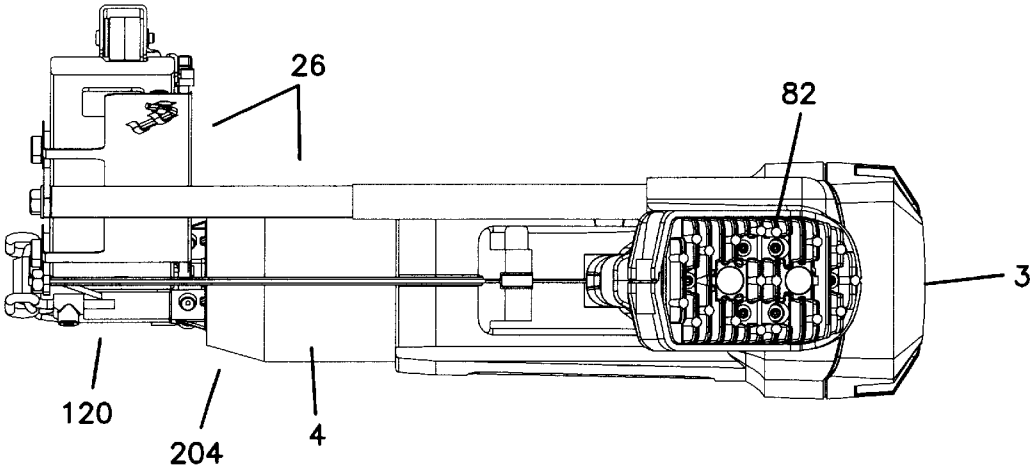
FIG. 37 is a bottom plan view.
Figure 39:
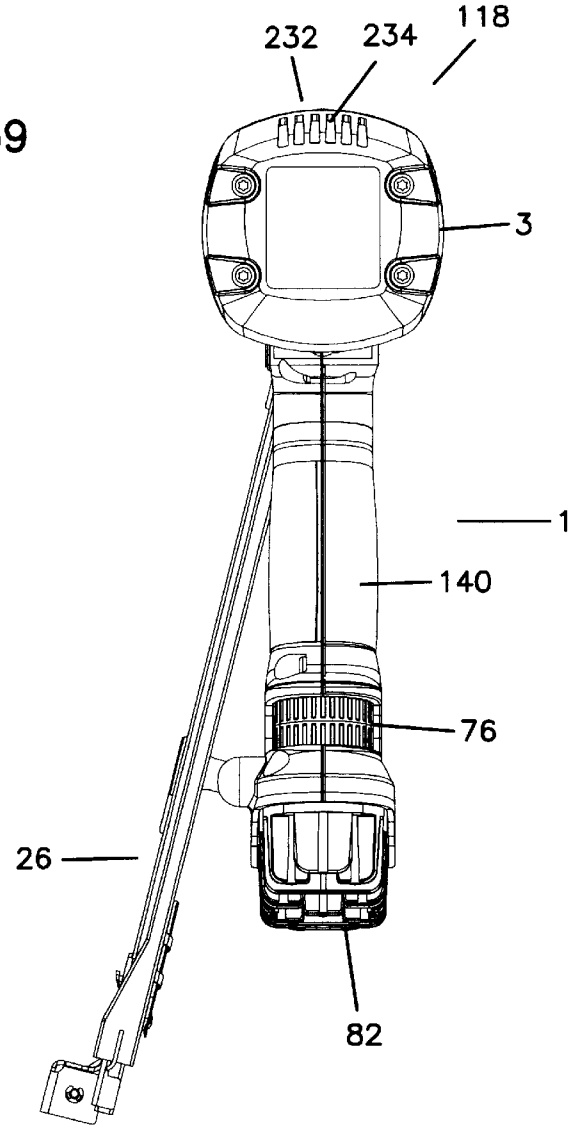
FIG. 39 is a rear elevational view.
Figure 38:
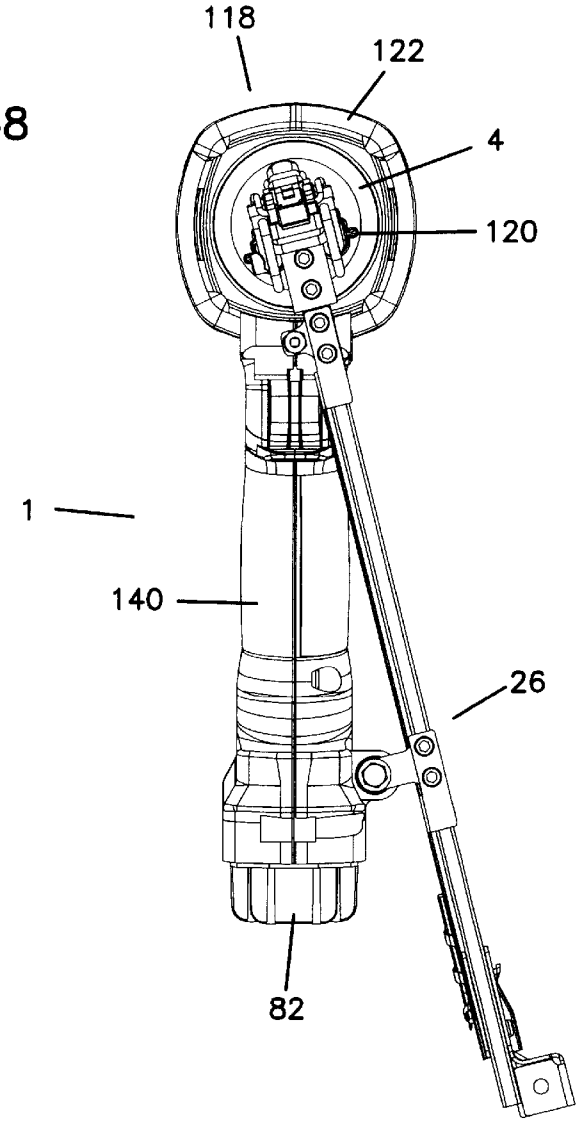
FIG. 38 is a front elevational view.
Figure 40:
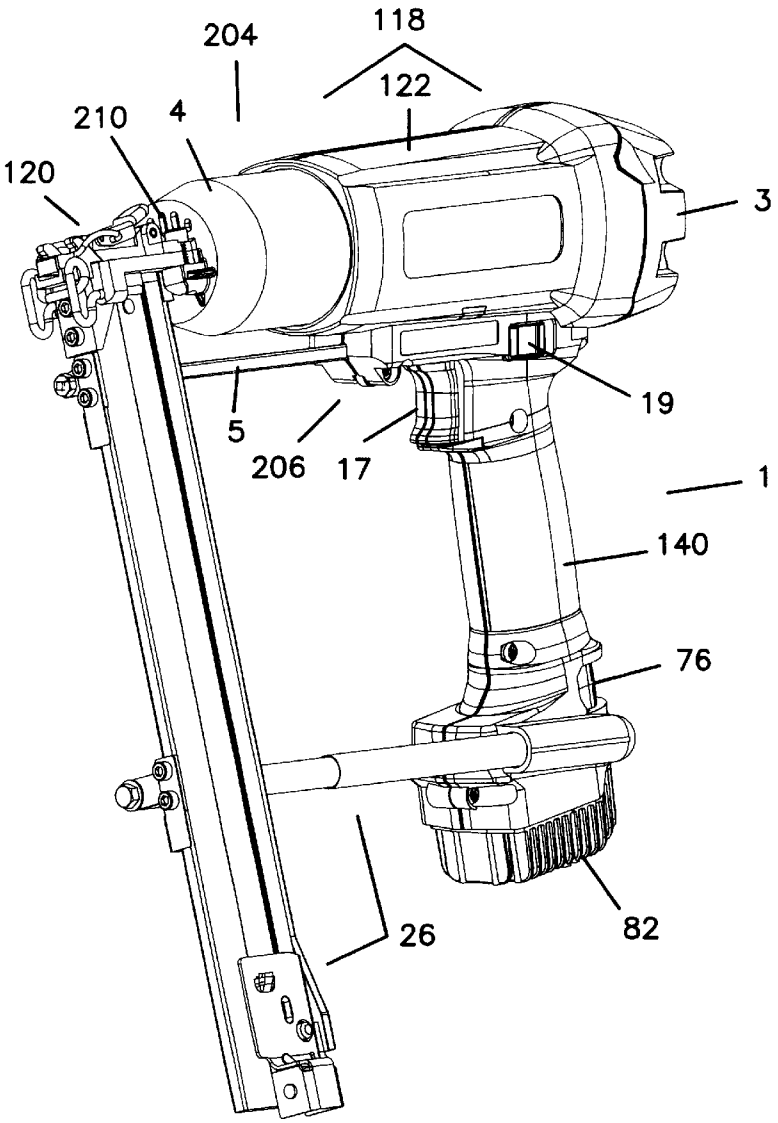
FIG. 40 is a front right perspective view.

An internal combustion fastener driver uses energy derived from internal combustion to drive a fastener, such as a nail, a staple, or the like. Lightweight fasteners, such as staples, can be driven to fasten thin or light materials such as wood paneling to a support. Heavier fasteners, such as large nails, can be driven to fasten materials such as framing studs or plywood. A portable internal combustion fastener driver generally includes a handle assembly, a motor unit, and a nose piece that holds a fastener to be driven. A front portion of the nose piece contacts a workpiece to be fastened, a fuel and air mixture is ignited within the motor unit to drive a driving member against the fastener and the fastener into the work piece, exhaust gases are released, and the fastener driver recycles to prepare for another ignition cycle. Thus, an internal combustion fastener driver provides an easy method for driving a single or numerous fasteners.

The internal combustion fastener driver generally employs a magazine of fasteners to facilitate sequential driving of fasteners without manually loading each fastener into the driver. Fastener magazines come in several forms, such as linear and drum-shaped. The preferred linear magazine maintains a row of fastener biased to be inserted into the nose piece for each driving cycle. Various designs of fastener magazines are known to those of skill in the art.

The preferred internal combustion fastener driving tool can be configured into many highly versatile configurations. The fastener driver system may be arranged and configured to include one or more of: a fuel metering system and shuttle valve that provide a regulated and metered source of gaseous fuel for repeatable, sequential combustion cycles; sequential and repeated manual cycling of air for combustion and for purging exhaust gases; providing effective combustion of a generally static mixture of fuel and air; drawing in air for combustion through a reed valve constructed to substantially eliminate adherence between the reed and seat portions; for providing power by internal combustion in a motor free of added or liquid lubricants; and providing a durable, lightweight, and generally non-ferrous motor. Such versatility is found in no other internal combustion fastener driver system.

To accomplish this, the present internal combustion fastener driver system preferably includes a fuel metering system including a port for receiving gaseous fuel, a regulator, and a shuttle valve. A preferred shuttle valve includes a metering chamber, a check valve, and one gating valve and provides asynchronous fluid communication between the metering chamber and the combustion chamber or between the metering chamber and the regulator. The present fastener driver system also, preferably, includes an improved manual recycling system. Improvements to the manual recycling system may include one or more of a linear cam system that is coupled to the manual recycler and to a fuel valve; providing a fuel air mixture using the manual recycling system and the fuel metering system; or coupling the manual recycling system to a trigger to allow activation of the ignition circuit when the manual recycler system has been compressed.

A preferred fastener driver system also includes an accelerator plate, which divides the combustion chamber into a primary region and a secondary region and directs ignited combustion gases from the primary region into the secondary region of the combustion chamber. Preferred embodiments of the accelerator plate include the accelerator plate having one or more of a slot, which can be arranged and configured to receive a fuel metering tube; a radially oriented fuel metering tube arranged and configured to dispense a metered amount of fuel into each of the primary region and the secondary region of the combustion chamber; or an electrode including an axially oriented pin substantially centrally located on the accelerator plate, which electrode is a component of a fuel ignition circuit.

The present fastener driver system preferably includes a piston having a self-lubricating compression ring arranged and configured around the circumference of the piston body to form a seal between the piston body and the cylinder or piston housing. The self-lubricating compression ring forms a durable seal in the absence of added lubricant. In another preferred embodiment, the fastener driving system includes a cylinder or piston housing having walls formed of an aluminum composition.

The preferred fastener driver system includes a handle system 1, a drive system 118, a magazine 26, and a nose piece 120. Handle system 1 is coupled to and supports drive system 118. The fastener driving system is operable through an internal combustion driven piston 45. Drive system 118 includes a driver body 122 which includes a piston housing 124. Piston 45 is slidably housed in piston housing 124. A driving member 48 is coupled to piston 45. A combustion chamber 126 is defined by driver body 122, piston housing 124, and piston 45. Piston 45 and driving member 48 are axially arranged and configured within piston housing 124 to drive a fastener upon combustion of a metered amount of gaseous fuel in combustion chamber 126.

Fuel System

A preferred fastener driving system includes a fuel metering system 128, which can provide a metered amount of gaseous fuel for combustion. A preferred fuel metering system 128 includes a port 130 for receiving gaseous fuel that is defined by the tool, a regulator 82 that is in fluid communication with port 130, and a shuttle valve 61. A preferred fuel is free of added lubricant.

Several components of fuel metering system 128 can advantageously be part of or be contained by handle system 1. In a preferred fuel metering system 128, a handle portion 140 of handle system 1 defines a receptacle 142 arranged and configured to receive a generally cylindrical container of gaseous fuel 77. Regulator 82 is retained on an end of handle 140 distal to driver body 122. The port for gaseous fuel 130 can be defined by parts of the fastener driving tool such as handle assembly 128, handle portion 140, receptacle 142, or regulator 82. Advantageously, port 130 is defined by regulator 82.

Regulator 82 typically is arranged and configured to regulate pressure of gaseous fuel delivered to shuttle valve 61. Preferably, regulator 82 is a two-stage regulator that, advantageously, regulates the pressure of gaseous fuel delivered to shuttle valve 61 to a desired pressure, for example, within about one pound per square inch (psi). Preferred regulator 82 also includes a circular mating portion 144 that sealably mates to generally cylindrical fuel container 77 and provides for fluid communication between fuel container 77 and regulator 82. Circular mating portion 144 preferably defines port for fuel 130.

Regulator 82 may be retained on handle 140 by a regulator retaining system 146. The regulator retaining system 146 shown includes a cross pin 148, a latch spring 65, and a latch slide 76. Cross pin 148 may be coupled to regulator 82 so that it is reversibly engaged by latch spring 65. Preferably, latch pin 148 is mounted on regulator 82 in an orientation generally perpendicular to an axis of handle 140 and generally perpendicular to an axis of piston housing 124. Cross pin 148, preferably, springingly engages latch spring 65. In the embodiment shown, latch slide 76 pressably engages latch spring 65 so that when latch slide 76 is pressed against latch spring 65, latch spring 65 releases cross pin 148, and regulator 82 can be removed from the tool. With regulator 82 removed from handle 140, fuel cartridge 77 can be removed from or inserted into receptacle 142.

Regulator 82 may be arranged and configured so that it can be mounted only in one orientation on handle system 1. This can be accomplished in several ways. By way of example, regulator 82 can be provided with a first end 149 and a second end 150, each end having a different shape complementary to the corresponding portion of handle system 1 and preventing regulator 82 from coupling with handle system 1 unless both complementary ends are in proper orientation. By way of further example, regulator 82 may define slot 152 that mates with a corresponding tab 154 on handle system 1.

Preferred regulator 82 maintains fluid communication with fuel cartridge 77 employing circular mating portion 144 and port 130. Regulator 82 reduces the pressure of gaseous fuel, preferably in two stages, to a preferred pressure (for example one that is constant within about 1 psi) at an exit port 156 defined by regulator 82. Regulator exit port 156 may be configured to reversibly mate with a first end 158 of fuel inlet tube 64. Fuel inlet tube 64 provides fluid communication between exit port 156 and shuttle valve 61. Second end 160 of fuel inlet tube 64 is shown coupled to shuttle valve 61.

A preferred shuttle valve 61 includes a metering chamber housing 132, a combustion check valve 136, and one gating valve 138. Metering chamber 134 and gating valve 138 are arranged and configured to provide asynchronous fluid communication between metering chamber 134 and combustion chamber 126 or between metering chamber 134 and regulator 82. Combustion check valve 136 is arranged and configured for preventing fluid flow from combustion chamber 126 to metering chamber 134. As is shown, gating valve 138 may be disposed between fuel inlet tube 64 and metering chamber 134.

In a preferred embodiment, gating valve 138 is a spool valve 162. Spool valve 162 preferably includes a tube 164 having a lumen 166 and a port system 168. A spring or other bias 172 in spool valve 162 can axially bias tube 164. In the configuration shown, when spring 172 is extended, regulator 82 is in fluid communication with metering chamber 134, and when spring 172 is compressed, there is no fluid communication between regulator 82 and metering chamber 134; rather, port system 168 and lumen 162 provide fluid communication between metering chamber 134 and outlet 178, which in turn is in fluid communication with combustion chamber 126. Typically, lumen 166 is in continuous fluid communication with check valve 138.

In a preferred embodiment, shuttle valve 61 is arranged and configured to be self-lubricating. That is, a self-lubricating shuttle valve 61 is arranged and configured to dispense gaseous fuel lacking added lubricant. Furthermore, self-lubricating shuttle valve 61 requires no added lubricant. Typically, self-lubricating shuttle valve 61 has requisite components made of material with lubricity that allows repeated actuation of shuttle valve 61 without added lubricant. A preferred self lubricating material is acetal. Dupont DELRIN® is a suitable acetal.

Preferably, housing components of metering chamber 61 also are made of such a self lubricating material. Shuttle valve 61 typically includes several housing components. In the embodiment shown, metering chamber housing 132 defines a metering chamber 134. As shown, a shuttle valve housing 174, which includes metering chamber housing 132, also houses combustion check valve 136 and gating valve 138. Shuttle valve housing 174 can also define an inlet 176 and an outlet 178. Preferably, inlet 176 has a barb 180 to make it a barbed inlet, and outlet 178 has a barb 180 to make it a barbed outlet. In a preferred embodiment, outlet 178 of shuttle valve 61 is in fluid communication with fuel metering tube 70. This fluid communication is typically provided by fuel outlet tube 87.

In a preferred embodiment, shuttle valve 61 includes a configuration of combustion check valve 136 that opens in response to little or substantially no cracking pressure. That is, when gating valve 138 is arranged to provide fluid communication between shuttle valve 61 and outlet 178, fuel in shuttle valve 61 can open and flow through combustion check valve 136 even when the fuel the same or only slightly greater pressure (for example less than 3 inches of water greater) than the gasses toward or past outlet 178 from combustion check valve 136. Preferably, such opening of combustion check valve 136 is accomplished by employing a combustion check valve 136 that lacks a spring; such a combustion check valve 136 is springfree. Similarly, in a preferred embodiment, pressure at the combustion chamber 126 or outlet 178, for example, only slightly greater than pressure in shuttle valve 61 can close combustion check valve 136.

In a preferred embodiment, fuel metering tube 70 and accelerator plate 33 provide a metered amount of fuel to combustion chamber 126; and accelerator plate 33 is arranged and configured to divide combustion chamber 126 into a primary region 182 and a secondary region 184. Typically, piston housing 124 has a circular cross-section perpendicular to its axis, and accelerator plate 33 is a generally circular disk that fills a cross-section of piston housing 124. Preferably, accelerator plate 33 has a plurality of orifices 200 that are proximal to piston housing 124, and fuel metering tube 70 provides a metered amount of fuel to each of primary region 182 and secondary region 184 which are, in part, bounded by accelerator plate 33.

U.S. Pat. Nos. 4,365,471 and 4,510,748 describe a control wall and U.S. Pat. No. 4,712,379 describes a detonation plate, each of which may be incorporated to provide certain of the structural and functional features of accelerator plate 33. These three patents are expressly incorporated herein by reference for their description of the features and functions of a control wall or detonation plate. Preferred accelerator plate 33 has features not found in the control wall or detonation plate described in these patents. Such features include a slot 186 in accelerator plate 33, fuel metering tube 70 incorporated in accelerator plate 33, an electrode 36 coupled to accelerator plate 33, or, preferably, a combination of these features.

In one embodiment, accelerator plate 33 includes electrode 36. Electrode 36 is involved in ignition of fuel in combustion chamber 126. Preferably, primary region 182 of combustion chamber 126 is bounded by accelerator plate 33 and cylinder head 32. In such an arrangement, primary region 182 contains spark gap 198, which is defined by spark plug 40 and electrode 36. Preferably, electrode 36 includes a pin 202 substantially centrally located on accelerator plate 33 and oriented generally along an axis of piston housing 124.

In one embodiment, accelerator plate 33 includes a slot 186. Preferably, slot 186 in accelerator plate 33 is radially oriented, intersects an outer edge of accelerator plate 33, and has a length less than or equal to the radius of accelerator plate 33. Preferably, accelerator plate slot 186 is arranged and configured to receive fuel metering tube 70. That is, preferably, fuel metering tube 70 can be inserted into and mate with slot 186. In another embodiment, fuel metering tube 70 is a component of accelerator plate 33.

In the embodiment shown, fuel metering tube 70 is arranged and configured to dispense a first portion of the metered amount of fuel into primary region 182 of combustion chamber 126 and a second portion of the metered amount of fuel into secondary region 184 of combustion chamber 134. Using such an arrangement, the first portion of fuel is dispensed through first fuel metering tube port 190 and the second portion of fuel is dispensed through second fuel metering port 192. Each orifice can be composed of a single or a plurality of openings in fuel metering tube 70, preferably each of ports 190 and 192 is a slot. The amount of fuel dispensed from ports 190 and 192 typically is determined, in part, by the relative size of the ports. Preferably, the first portion of fuel includes about ⅓ of the total fuel and the second portion of fuel includes about ⅔ of the total amount of fuel. Such a distribution of fuel can be achieved by having ports of the same shape with a surface area proportional to the amounts of fuel to be dispensed from each port. The orientation of port 190 or port 192 can be chosen to direct the fuel at a particular angle with respect to the accelerator plate. Preferably, first port 190 directs fuel at a 45° angle to accelerator plate 33. The angle can be selected to provide, among other advantages, turbulence and swirl in the fuel air mixture in primary region 182 of combustion chamber 126.

Fuel metering tube 70 typically enters combustion chamber 126 through a side of piston housing 124. Preferably, port 194 for fuel metering tube 70 is in a side of cylinder head 32 proximal to the portion of cylinder head 32 that mates with combustion chamber wall 196.

Recycler and Cam Systems

A manual recycler for a detonating impact tool has been described in U.S. Pat. No. 4,712,379 issued to Adams, et al. on Dec. 15, 1987. This patent is expressly incorporated herein by reference. The Adams manual recycler includes a front housing that compresses into a main housing when the tool is pressed against a work piece, but that is generally biased outwardly by a compression spring. Compressing the housings charges a combustion chamber with fuel and air for detonation to drive a piston. Following detonation, expansion of the housing draws purging, cooling, and recharging air into the combustion chamber. A preferred fastener driving tool of the present invention includes a manual recycler with several improvements over the manual recycler of U.S. Pat. No. 4,712,379. For example, the present improved manual recycler includes a pump system 204, a linear cam system 206, a trigger 17 or, preferably, a combination of these features. In addition, the manual recycler can be improved by working in conjunction with fuel metering system 128.

A preferred embodiment of the fastener driving system includes an improved manual recycler having pump system 204. Pump system 204 typically includes an intake system 208, an exhaust system 210, a pump sleeve 31, a pump housing 4, and piston housing 124. In the embodiment shown, pump sleeve 31 sealably contacts piston housing 124 and defines a space 212 around piston housing 124. The sealable contact of pump sleeve 31 and piston housing 124 can include pump sleeve O-ring 30 or another suitable mechanism for forming a durable seal. Pump housing 4 preferably is arranged and configured to move axially in space 212 around piston housing 124 defined by pump sleeve 31 such that pump housing 4 moves along an axis of pump sleeve 31 and/or an axis of piston housing 124. A pump compression spring 28 in space 212 may be employed to axially bias pump housing 4 to extend out of or from space 212. In the preferred embodiment, intake system 208 is arranged and configured for fluid communication between the combustion chamber 126 and the exterior of the tool, and exhaust system 210 is arranged and configured for fluid communication between space 212 and the exterior of the tool.

A preferred embodiment of the fastener driving system includes a linear cam system 206 coupled to pump system 204 and a fuel valve 214, such as shuttle valve 61. Preferred linear cam system 206 is arranged and configured to activate fuel valve 214 upon compression of pump housing 4 into space 212, and preferred fuel valve 214 is arranged and configured to dispense gaseous fuel into combustion chamber 126 upon activation. In the embodiment shown in the Figures, linear cam system 206 does not extend beyond nose piece 120 in the direction of a workpiece.

In the embodiment shown in the Figures, linear cam system 206 includes a linear cam 5, a pivot bracket 34, a cam roller 57 and a cam ball bearing 35. Linear cam 5 is coupled to pump housing 4, typically by way of magazine 26 and nose piece 120, and is positioned to slidably engage cam roller 57 by cam ball bearing 35. Cam roller 57 is coupled to pump sleeve 31 employing pivot bracket 34 and pump shell 216. Linear cam 5 slidably engages cam roller 57 and pivot bracket 34, which in turn engages fuel valve 214. Pivot bracket 34 is coupled to pump housing 31, typically via a portion of driver body 122. Compression of pump housing 4 into space 212 slides linear cam 5 relative to cam roller 57 and pivot bracket 34, pivots pivot bracket 34, and actuates fuel valve 214. In a preferred embodiment, actuation of fuel valve 214 opens fluid communication between a source of fuel and combustion chamber 126. In a particularly preferred embodiment, linear cam system 206 actuates gating valve 138 of shuttle valve 61. Through such actuation of shuttle valve 61, pump system 204 and linear cam system work in conjunction with fuel metering system 128 and provides the advantages of fuel metering system 128.

In the preferred fastener driving system, linear cam system 206 is also coupled to trigger 17 and arranged and configured to prevent actuation of trigger 17 unless pump housing 4 is compressed into space 212. Preferably, linear cam system 206 pressably engages lockout plate 63, typically employing pivot bracket 34 to pressably contact lockout plate 63. Lockout plate 63 has a rest position and a firing position, and is moved between positions upon pressing by linear cam system 206. For this movement between positions, pivot bracket 34 presses lockout plate 63 from its rest position to the firing position as pump housing 4 is compressed into space 212. In the rest position, lockout plate 63 prevents actuation of trigger 17. When lockout plate 63 is in firing position, trigger 17 can be actuated.

A preferred embodiment of the fastener driving tool includes a lockout latch 218 arranged and configured to prevent gating valve 138 from establishing fluid communication with regulator 82. Lockout latch 218 includes slide switch 19 having on one side lockout tab 220, which engages pivot bracket 34 and retains pivot bracket 34 in its pivoted position and also retains gating valve 138 and metering chamber 134 in fluid communication with combustion chamber 126. Such action of lock out latch 218 prevents fuel metering system 128 from supplying additional fuel to combustion chamber 126.

In a preferred embodiment, the fastener driving tool includes ignition system 222, which includes spark plug 40, trigger 17, a piezoelectric device 60, and, optionally, electrode 36 on accelerator plate 33. Electrode 36 and spark plug 40 define spark gap 198. Trigger 17 is coupled to piezoelectric device 60 and arranged and configured to activate piezoelectric device 60. For example, pressing trigger 17 can deform piezoelectric device 60 and generate current for ignition. Piezoelectric device 60 is arranged and configured to provide current to spark plug 40. For example, piezoelectric device 60 can be coupled to spark plug 40 employing insulated conductor 224. Typically, trigger 17 is coupled to linear cam system 206, which is arranged and configured to prevent actuation of trigger 17 unless pump housing 4 is compressed into space 212. Such coupling prevents generation of a spark in the combustion chamber when the tool is released from a work piece or otherwise not compressed.

In one embodiment, pump system 204 includes a decompression system 225, which is arranged and configured to provide fluid communication from the interior of piston housing 124, into space 212, and through exhaust system 210 to surroundings of the tool. Decompression system 225, intake system 208, piston housing 124, and piston 45 are arranged and configured so that a downstroke of piston 45 pulls air through intake system 208 into combustion chamber 126. In addition, a piston upstroke expels air from the interior of piston housing 124 through decompression port 226 and decompression system 225. The piston upstroke leaves an amount of air in combustion chamber 126 sufficient to combust a measured amount of fuel dispensed by shuttle valve 61.

Such an improved manual recycler is an advantageous way of manually starting an internal combustion fastener driving tool. The improved manual recycler employs application of an external source of power to start the engine and allow combustion powered movement of the piston. The external source of power is the user of the tool who compresses the fastener driving tool, which, in the embodiment shown, moves pump housing 4 into space 212, slides piston 45 from a rest position 264 to a firing position 268, and compresses air in combustion chamber 126. Starting the tool employs movement of piston 45 to compress air in combustion chamber 126 to a pressure higher than atmospheric conditions. Typically, the tool is compressed by an operator pushing or compressing the tool against a workpiece and, after the tool is compressed, gripping or pressing trigger 17 to fire the tool. In the embodiment shown in the Figures, pushing or compressing the tool against a workpiece actuates fuel valve 214 or shuttle valve 61, dispenses fuel through fuel metering tube 70, and creates turbulence or swirling of fuel and air in combustion chamber 126.

Intake System and Reed Valve

Intake system 208 is typically at an end of combustion chamber 126. Intake system 208 typically includes a reed valve 228 arranged and configured as a check valve and permitting fluid flow into combustion chamber 126 from surroundings of the tool. Reed valve 228 typically includes a reed portion 37 and a seat portion 230. Preferably, seat portion 230 is substantially nonresilient. Nonresilient seat 230 substantially eliminates adherence of reed portion 37 to seat portion 230. Intake system 208, optionally, also includes an air intake port 232 defined by driver body 122. Air intake port 232 can include a plurality of apertures 234 in an end cap 3 of driver body 122, which ports are arranged and configured for receiving air from surroundings of the tool and are in fluid communication with reed valve 228. Intake system 208 includes an air filter 95 arranged and configured between surroundings of the tool and reed valve 228 to prevent undesirable particulates from interfering with the operation of reed valve 228 or entering combustion chamber 126.

In one embodiment of the present fastener driving system, reed valve 228 is retained on a cylinder head by an apparatus employing spark plug 40. Spark plug 40 is arranged and configured to couple to cylinder head 32 and to retain reed valve 228 on a cylinder head intake port 236 defined by cylinder head 32. Cylinder head intake port 236 is arranged and configured to receive air from surroundings of the tool, and is in fluid communication with reed valve 228. Spark plug 40 includes spark plug electrode 39 and spark plug body 238, which is arranged and configured for sealably retaining a spark plug O-ring 262 and a valve support 41. Valve support 41 sandwiches reed portion 37 and retains reed portion 37 on cylinder head 32, and, in the absence of air flow into the combustion chamber, against seat portion 230. Spark plug body 238 defines an axial bore 240 that houses spark plug electrode 39 and that is arranged and configured to retain piezoelectric conductor 224 on spark plug electrode 39 and spark plug 40.

A preferred embodiment of reed valve 228 is arranged and configured to open in response to a pressure of less than about 3 inches of water. Preferred reed valve 228 can be arranged and configured with a surface area to provide a substantially leak-proof seal at firing pressure in combustion chamber 126. This is advantageously accomplished by employing in reed valve 228 a steel reed portion 37 and an aluminum seat 230. A preferred seat 230 is made of coined metal. Coining metal refers to stamping a metal under sufficient pressure that the metal flows without melting. For example, cylinder head 32 can be cast from aluminum or an aluminum alloy and then a portion can be coined to form seat 230.

Preferred aluminum seat 230 is formed from a material that is largely an aluminum alloy, or, an aluminum composition, which aside from incidental impurities and other compounds generally found in aluminum, is aluminum. In one embodiment, aluminum seat 230 is made of an aluminum alloy or essentially of aluminum. The preferred aluminum seat 230 has sufficient surface hardness to withstand repeated contact with reed portion 37 during combustion cycles and sufficient smoothness to allow an extended lifetime of reed valve 228. Such a hardness is about 58 on the Rockwell C-scale. Such smoothness is typically less than about 24 RMA. A preferred material for obtaining these properties is hard-coat anodized aluminum. Additional preferred aluminum compositions or aluminum alloys include impact-extrudable aluminum, 6061 aluminum, or a combination of any of these preferred aluminums compositions and aluminum alloys.

Piston, Compression Ring, and Piston Housing

A preferred fastener driving system includes piston 45 having a piston body 242 and at least one self-lubricating compression ring 44. Compression ring 44 is arranged and configured to be retained around the circumference of piston body 242 and to form a seal between piston body 242 and piston housing 124. Self-lubricating compression ring 44 forms a durable seal in the absence of added lubricant. That is, neither the gaseous fuel nor piston housing 124 contain an added lubricant. A preferred self lubricating compression ring 44 is made of material including polyterfluoroethylene (PTFE) and carbon fiber.

In a preferred embodiment, piston 45 includes two compression rings 44. First compression ring 256 is retained around the circumference of piston body 242 proximal to combustion chamber 126. Second compression ring 258 is retained around the circumference of piston body 242 at an end of piston body 242 distal to combustion chamber 126. First compression ring 256 and second compression ring 258 are retained on piston body 242 by a compression ring retaining system 244, which includes grooved retaining ring 113, retaining ring 46, and piston O-ring 112. A preferred piston 45 includes compression ring retaining system 244.

Compression ring 44 can be retained on piston body 242 by either grooved retaining ring 113 and piston O-ring 112, or by retaining ring 46. Grooved retaining ring 113 is arranged and configured to retain compression ring 44 around the circumference of piston body 242, in order to maintain sealable contact between compression ring 44 and piston housing 124, in order to be retained around the circumference of piston body 242, and in order to retain piston O-ring 112. Piston O-ring 112 urges compression ring 44 into sealable contact with piston housing 124. Preferably, first compression ring 256 is retained by grooved retaining ring 113. Retaining ring 46 is arranged and configured to retain compression ring 44 around a circumference of piston body 242, to maintain sealable contact between compression ring 44 and piston housing 124, and to be retained around the circumference of piston body 242. Preferably, second compression ring 258 is retained by retaining ring 46. Preferably, each of retaining rings 113 and 46 has a convex surface that is placed adjacent to compression ring 44 and two flat surfaces, one of which is adjacent to piston body 242. Grooved retaining ring 113 typically has a groove in the convex surface to retain piston O-ring 112.

Piston body 242 is arranged and configured to couple to driving member 48. Driving member 48 is arranged and configured to, in conjunction with piston 45, transmit energy from combustion to driving a fastener 254. Preferred driving member 48 is an elongated blade coupled to piston head 242 and extending into nose piece 120. Preferred, blade-like, driving member 48 defines a hole 250 proximal to an end that fits into a slot-shaped aperture 246 defined by piston body 242. Piston body 242 also defines a hole 248 that aligns with driving member hole 250 and receives pin rolls 49, 50 which are arranged and configured to couple driving member 48 to piston 45.

Piston housing 124 includes piston chamber wall 29, which, preferably, is generally cylindrically and combustion chamber wall portion 196, which, preferably, is in the shape of a truncated cone. Piston housing 124 also includes cylinder head 32. Cylinder head 32 is coupled to the remainder of piston housing 124 to provide a sealed internal combustion cylinder. Preferably, piston 45 is housed by chamber wall 29 of piston housing 124. Piston chamber wall 29 of piston housing 124 is generally cylindrical to house piston body 242 which has sections that are either generally ring-shaped or generally disk-shaped. Piston body 242 is sized to sealably occupy together with compression ring 44 a radial cross-section of piston housing 124. Piston body 242 in one embodiment defines a cavity 260 that is in fluid communication with combustion chamber 126.

Preferred piston chamber wall 29 is formed from a material that is largely an aluminum alloy, or, an aluminum composition, which aside from incidental impurities and other compounds generally found in aluminum, is aluminum, or is essentially aluminum. In one embodiment, entire piston housing 124 is made of the material used for piston chamber wall 29. A preferred aluminum alloy or composition is suitable for use with fuel lacking an added lubricant and in the absence of added liquid lubricant. The preferred piston chamber wall has sufficient surface hardness to withstand repeated travel of piston 45 of an internal combustion engine and sufficient smoothness to allow an extended lifetime of a compression ring 44. Such a hardness is about 58 on the Rockwell C-scale. Such smoothness is typically less than about 24 RMA. A preferred material for obtaining these properties is hard-coat anodized aluminum. Additional preferred aluminum compositions or aluminum alloys include impact-extrudable aluminum, 6061 aluminum, or a combination of any of these preferred aluminums compositions and aluminum alloys.

In the preferred embodiment, piston housing 124 also includes one or more decompression ports 226 and one or more exhaust ports 252. Piston 45 is arranged and configured for axially sliding, relative to the piston housing, from a rest position 264 through an intermediate position 266, and to a firing position 268 as pump housing 4 is axially compressed into space 212. In this sliding, which occurs during firing and preparing tool for firing, piston 45 travels by decompression ports 226 and exhaust ports 252. When piston 45 is in its rest position, exhaust port 252 and decompression port 226 provide fluid communication between combustion chamber 126 and exhaust system 210. When piston 45 is in its intermediate position, decompression port 226, but not exhaust port 252, provides fluid communication between combustion chamber 126 and exhaust system 210. When piston 45 is in its firing position, neither exhaust port 252 nor decompression port 228 provides fluid communication between combustion chamber 126 and exhaust system 210. In its firing position, piston 45 is located proximal the junction of piston chamber wall 29 and combustion chamber wall 196. In its intermediate position, piston 45 is located between exhaust port 252 and decompression port 228. In its rest position, piston 45 is located at an end of piston chamber wall 29 proximal to exhaust system 210.

Decompression port 228 reduces the pressure required to compress piston housing 4 into space 212 and to move the piston from its rest position to its firing position. Preferably, decompression port 228 is located on piston chamber wall 29 a short distance from combustion chamber wall 196. Preferably, there are a plurality of decompression ports 228. Preferably about 6 to about 8 decompression ports are arranged and configured to provide adequate passage of air for decompression without causing undue wear on compression ring 44.

Exhaust ports 252 are in fluid communication with preferred exhaust system 210, which is located in an end of pump housing 4 proximal to nose piece 120. Exhaust ports 252 are arranged and configured to provide for adequate flow of exhaust gases from combustion chamber 126 and piston chamber wall 29 and to avoid undue wear on compression ring 44. Preferably, there are a plurality of exhaust ports 252. Exhaust system 210 typically includes a port defined by pump housing 4 and an exhaust valve 51 arranged and configured as a check valve allowing escape of fluid from the pump housing. Preferably, exhaust valve 51 is a reed valve. Preferably, exhaust system 210 is at an end of pump housing 4 distal to its sealable contact with pump sleeve 31.

Methods Employing the Tool

Internal combustion engines can be flooded by excess fuel. The construction of the present fastener driving system provides for a method for restarting the tool including steps to purge the tool of a flooding mixture of fuel and air and to introduce a combustible mixture of fuel and air for further operation of the tool.

A preferred method for restarting a flooded fastener driving tool starts with compressing the tool against an object to purge a flooding mixture of fuel and air from combustion chamber 126. This also closes fluid communication from metering chamber 134 to regulator 82, to a conduit between metering chamber 134 and regulator 82, to a source of gaseous fuel, or to a combination of these. Then, the tool is manipulated to prevent further fuel from entering the combustion chamber during further compression and extension of the tool. This can be accomplished by latching closed the valve, cam, conduit or system that provides fluid communication between metering chamber 134 and regulator 82 or an other source of gaseous fuel. Preferably, lockout latch 218 is pressed against and retains pivot bracket 34 in pivoted position and retains gating valve 138 in fluid communication with combustion chamber 126.

With further fuel prevented from entering combustion chamber 126, any residual flooding mixture of fuel and air in combustion chamber 126 is replaced with air from the surroundings of the tool. This can be accomplished by drawing air into combustion chamber 126 by releasing the tool from the object against which it is compressed, and then purging the air and any residual mixture of fuel and air from combustion chamber 126 by compressing the tool against the object. The drawing and purging steps can be repeated one or more times, preferably to achieve three drawing and purging cycles. The tool can then be made ready for firing by opening fluid communication between regulator 82 or another fuel source and combustion chamber 126 followed by driving fastener 254 using the tool.

Compressing the fastener driving tool against an object operates pump system 204 which is coupled to linear cam system 206. Compressing the tool against an object includes compressing linear cam 5 and sliding linear cam 5 against cam roller 57 and pivot bracket 34. This results in actuating spool valve 162 with pivot bracket 34 to close off fluid communication between metering chamber 134 and regulator 82 or another source of gaseous fuel. Actuating spool valve 162 includes pressing spring-biased tube 164 from an extended configuration providing fluid communication between metering chamber 134 and regulator 82 to a compressed configuration providing fluid communication between metering chamber 134 and combustion chamber 126. Latching closed fluid communication preferably includes sliding lockout latch 19 to reversibly contact linear cam system 206 and pressably bias pivot bracket 34 against spool valve 162. Opening fluid communication is the reverse of this action, sliding lockout latch 19 to remove the latch from contact with pivot bracket 34.

The construction of the present fastener driving tool provides for a method of driving a fastener 254 with the tool. Driving a fastener with the present fastener driving tool includes steps for introducing fuel and air into combustion chamber 126, compressing the tool to operate a safety mechanism that prevents firing the tool unless it is compressed, preferably against a workpiece, and combusting the mixture of fuel and air to drive fastener 254.

A preferred method for driving fastener 254 with the tool of the present invention includes positioning a fastener 254 within the tool for driving by the tool. The tool gains its power from internal combustion, and the method includes providing a source of gaseous fuel to power internal combustion driven piston 45. So that the fastener is driven where desired, the method includes positioning the tool on a work piece at a position for driving fastener 254. Compressing the tool body against the work piece moves lockout plate 63 to allow actuation of trigger 17 for firing the tool. Actuating the trigger fires the tool and drives the fastener. Releasing the tool from the work piece and expanding the compressed tool provides for driving another fastener.

Compressing the tool against the work piece operates pump system 204 of the improved manual recycler. Compressing the tool against the work piece includes compressing linear cam system 206 and sliding the linear cam 5 against cam roller 5 and pivot bracket 34. This compressing results in actuating spool valve 162 with pivot bracket 34 to open fluid communication between metering chamber 134 and combustion chamber 126. This results in releasing into combustion chamber 126 no more than a stoichiometric amount of fuel with respect to the amount of air in combustion chamber 126. Actuating spool valve 162 includes pressing spring-biased tube 164 from an extended configuration providing fluid communication between metering chamber 134 and regulator 82 to a compressed configuration providing fluid communication between metering chamber 134 and combustion chamber 126. Compressing the tool against a work piece includes compressing linear cam system 206 and sliding linear cam 5 against cam roller 57 and pivot bracket 34. This results in pressing pivot bracket 34 against lockout plate 63 and moving lockout plate 63 from a rest position to a firing position, which allows actuation of trigger 17. Actuation of trigger 17 then results in internal combustion and driving of fastener 254.

The present invention is applicable to numerous different fastener driver devices and methods employing them. Accordingly, the present invention should not be considered limited to the particular examples described above, but rather should be understood to cover all aspects of the invention as fairly set out in the attached claims. Various modifications, equivalent processes, as well as numerous structures to which the present invention may be applicable will be readily apparent to those of skill in the art upon review of the present specification. The claims are intended to cover such modifications and devices.

What is claimed is:

1. A fastener driving tool operable through an internal combustion driven piston, the tool comprising:

(a) a driver body comprising a piston housing, a piston slidably housed in the piston housing, a driving member coupled to the piston; a combustion chamber defined by the body, piston housing, and piston; the piston and driving member being axially arranged and configured within the piston housing to drive a fastener upon combustion of a metered amount of gaseous fuel in the combustion chamber;

(b) a pump system; the pump system comprising an intake system, an exhaust system, a pump sleeve, a pump housing, and the piston housing; the pump sleeve sealably contacting the piston housing and defining a space around the piston housing; the pump housing being arranged and configured to move axially in the space and to sealably contact the pump sleeve; a pump compression spring in the space axially biasing the pump housing; the intake system being arranged and configured for fluid communication with the combustion chamber; the exhaust system being arranged and configured for fluid communication with the space; and (c) a linear cam system and a fuel valve; the linear cam system being arranged and configured to activate the fuel valve upon compression of the pump housing into the space; the fuel valve being arranged and configured to dispense a metered amount of gaseous fuel into the combustion chamber upon activation.

2. The fastener driving tool of claim 1, the linear cam system further comprising a linear cam, a pivot bracket, and a cam roller; the pivot bracket and cam roller being coupled to the pump sleeve; the linear cam being coupled to the pump housing and slidably engaging the pivot bracket and cam roller; the pivot bracket engaging the fuel valve; compression of the pump housing into the space sliding the linear cam relative to the pivot bracket, pivoting the pivot bracket, and actuating the fuel valve.

3. The fastener driving tool of claim 1, wherein the tool further comprises a port defined by the tool for receiving gaseous fuel and a shuttle valve;

the shuttle valve comprising a metering chamber housing, a metering chamber defined by the metering chamber housing, a combustion check valve, and one gating valve; the metering chamber and gating valve being arranged and configured to provide asynchronous fluid communication between the metering chamber and the combustion chamber or between the metering chamber and the port defined by the tool for receiving gaseous fuel; the combustion check valve being arranged and configured for preventing fluid flow from the combustion chamber to the metering chamber;

the fuel valve being the gating valve.

4. The fastener driving tool of claim 3, wherein the gating valve is a spool valve.

5. The faster driving tool of claim 4, wherein the spool valve comprises:

a tube having a lumen and a port system; and a spring arranged and configured to axially bias the tube;

wherein when the spring is in an extended configuration the spool valve is arranged and configured for fluid communication between the metering chamber and the regulator, and when the spring is compressed the second port system and the lumen provide fluid communication between the metering chamber and the combustion chamber.

6. The fastener driving tool of claim 3, wherein the lock out latch, retains the pivot bracket in the pivoted position and the gating valve in the actuated position.

7. The fastener driving tool of claim 1, the tool further comprising a trigger, the trigger being coupled to the linear cam system, the linear cam system being arranged and configured to prevent actuating of the trigger unless the pump housing is compressed into the space.

8. The fastener driving tool of claim 7, wherein the linear cam system pressably engages a lock out plate, the lock out plate having a rest position and a firing position, the pivot bracket pressing the lock out plate from the rest position to the firing position when the pump housing is compressed into the space, the lock out the plate preventing actuation of the trigger in the rest position and allowing actuation of the trigger in the firing position.

9. The fastener driving tool of claim 1, further comprising a lock out latch arranged and configured to prevent the gating valve from establishing fluid communication with the regulator.

10. The fastener driving tool of claim 1, the tool further comprising a spark plug, a trigger and a piezoelectric device;

the piston housing comprising an accelerator plate; the accelerator plate comprising a disk radially oriented within the piston housing and an electrode; the accelerator plate being arranged and configured to divide the combustion chamber into a primary region and a secondary region and to direct ignited combustion gasses from the primary region into the secondary region of the combustion chamber; the electrode comprising an axially oriented pin; the pin being oriented toward and forming a spark gap with the spark plug;

the trigger being coupled to the piezoelectric device and arranged and configured to activate the piezoelectric device; the piezoelectric device being arranged and configured to provide current to the spark plug; and the trigger being coupled to the linear cam system, the linear cam system being arranged and configured to prevent actuating of the trigger unless the pump housing is compressed into the space.

11. A fastener driving tool operable through an internal combustion driven piston, the tool comprising:

(a) a driver body comprising a piston housing, a piston slidably housed in the piston housing, a driving member coupled to the piston; a combustion chamber defined by the body, piston housing, and piston; the piston and driving member being axially arranged and configured within the piston housing to drive a fastener upon combustion of a metered amount of gaseous fuel in the combustion chamber;

(b) a pump system; the pump system comprising an intake system, an exhaust system, a pump sleeve, a pump housing, and the piston housing; the pump sleeve sealably contacting the piston housing and defining a space around the piston housing; the pump housing being arranged and configured to move axially in the space and to sealably contact the pump sleeve; a compression spring in the space axially biasing the pump housing; the intake system being arranged and configured for fluid communication with the combustion chamber; the exhaust system being arranged and configured for fluid communication with the space; and (c) a fuel metering system comprising:

(i) a port defined by the tool for receiving gaseous fuel;

(ii) a regulator in fluid communication with the port;

(iii) a shuttle valve in fluid communication with the regulator;

(d) the shuttle valve comprising a metering chamber housing, a metering chamber defined by the metering chamber housing, a combustion check valve and one gating valve; the metering chamber and gating valve being arranged and configured to provide asynchronous fluid communication between the metering chamber and the combustion chamber or between the metering chamber and the regulator; the combustion check valve arranged and configured for preventing fluid flow from the combustion chamber to the metering chamber.

12. The tool according to claim 11, the tool further comprising a handle, the handle defining a receptacle arranged and configured to receive a generally cylindrical container of gaseous fuel; the handle comprising the regulator at an end of the handle distal to the driver body;

the regulator being a two stage regulator adapted and configured to regulate the pressure of the gaseous fuel delivered to the port for receiving gaseous fuel to within about 1 psi.

13. The tool of claim 12, further comprising a regulator retaining system; the regulator retaining system comprising a cross pin, a latch spring, and a latch slide; the cross pin being coupled with the regulator and being springingly engaged by the latch spring; the latch slide pressably engaging the latch spring; the latch spring releasing the cross pin when pressed by the latch slide.

14. The fastener driving tool of claim 11, wherein the metering chamber has a volume sufficient to provide an about stoichiometric amount of fuel to the air in the combustion chamber.

15. The fastener driving tool of claim 11, wherein the gating valve is a spool valve.

16. The faster driving tool of claim 15, wherein the spool valve comprises:

a tube having a lumen and a first port system; and a spring arranged and configured to axially bias the tube;

wherein when the spring is in an extended configuration the spool valve is arranged and configured for fluid communication between the metering chamber and the regulator, and when the spring is compressed the second port system and the lumen provide fluid communication between the metering chamber and the combustion chamber.

17. The fastener driving tool of claim 11, the piston housing comprising an accelerator plate, the accelerator plate comprising a disk radially oriented within the piston housing and an electrode comprising an axially oriented pin; the accelerator plate being arranged and configured to divide the combustion chamber into a primary region and a secondary region and to direct ignited combustion gasses from the primary region into the secondary region of the combustion chamber;

the tool further comprising a fuel metering tube, a spark plug, a piezoelectric device, and a trigger; the fuel metering tube being arranged and configured to dispense a first portion of the metered amount of fuel into the primary region of the combustion chamber and to dispense a second portion of fuel into the secondary region of the combustion chamber; the pin being oriented toward the spark plug; the trigger being coupled to the piezoelectric device and arranged and configured to activate the piezoelectric device; the piezoelectric device being arranged and configured to provide current to the spark plug upon activation by the trigger; the spark plug being arranged and configured to ignite a mixture of fuel and air in the combustion chamber.

18. The fastener driving tool of claim 11, further comprising a linear cam system; the linear cam system being arranged and configured to actuate the gating valve for fluid communication between the port for fuel and the combustion chamber upon compression of the pump housing into the space.

19. The fastener driving tool of claim 18, the linear cam system further comprising a linear cam, a pivot bracket, and a cam roller; the pivot bracket and cam roller being coupled to the pump sleeve; the linear cam being coupled to the pump housing and slidably engaging the pivot bracket and cam roller; the pivot bracket engaging the fuel valve; compression of the pump housing into the space sliding the linear cam relative to the pivot bracket, pivoting the pivot bracket, and actuating the fuel valve.

20. The fastener driving tool of claim 19, further comprising a lock out latch arranged and configured to prevent the gating valve from establishing fluid communication with the regulator.

21. The fastener driving tool of claim 20, wherein the lock out latch, retains the pivot bracket in the pivoted position and the gating valve in the actuated position.

22. The fastener driving tool of claim 11, wherein the intake system further comprises a reed valve arranged and configured as a check valve permitting fluid flow into the combustion chamber.

23. The fastener driving tool of claim 22, the tool further comprising a cylinder head defining a portion of the combustion chamber; the reed valve being located on an interior surface of the cylinder head, the reed valve comprising a reed portion and a substantially nonresilient seat portion; whereby the nonresilient seat substantially eliminates adherence of the reed portion to the seat portion.

24. The fastener driving tool of claim 22, wherein the pump system further comprises a decompression port; the intake system, decompression port, piston housing, and piston being arranged and configured so that a downstroke of the piston pulls air through the reed valve into the combustion chamber, and so that a piston upstroke expels excess air through the decompression port; the piston upstroke leaving an amount of air in the combustion chamber sufficient to combust the metered amount of fuel.

25. The fastener driving tool of claim 22, wherein the intake system further comprises a cylinder head intake port defined by the cylinder head, arranged and configured for receiving air from surroundings of the tool, and being in fluid communication with the reed valve.

26. The fastener driving tool of claim 25, further comprising a spark plug; the spark plug being arranged and configured to couple to the cylinder head and to retain the reed valve on the intake port.

27. The fastener driving tool of claim 26, wherein the spark plug comprises an electrode and a spark plug body arranged and configured for sealably retaining an O-ring and an intake reed valve between the spark plug body and the cylinder head; the spark plug body defining an axial bore that houses the electrode and that retains a connector on the electrode.

28. The fastener driving tool of claim 11, wherein the intake system is at an end of the combustion chamber.

29. A fastener driving tool operable through an internal combustion driven piston, the tool comprising:

(a) a driver body comprising a piston housing, a piston slidably housed in the piston housing, a driving member coupled to the piston; a combustion chamber defined by the body, piston housing, and piston; the piston and driving member being axially arranged and configured within the piston housing to drive a fastener upon combustion of a metered amount of gaseous fuel in the combustion chamber;

(b) a pump system; the pump system comprising an intake system, an exhaust system, a pump sleeve, a pump housing, and the piston housing; the pump sleeve sealably contacting the piston housing and defining a space around the piston housing; the pump housing being arranged and configured to move axially in the space and to sealably contact the pump sleeve; a compression spring in the space axially biasing the pump housing; the intake system being arranged and configured for fluid communication with the combustion chamber; the exhaust system being arranged and configured for fluid communication with the space; and (c) a trigger; the trigger being coupled to the pump system and arranged and configured to activate an ignition circuit only upon compressing the pump housing into the space and actuating the trigger.

30. The fastener driving tool of claim 29, further comprising a linear cam system, the linear cam system being arranged and configured to prevent actuating of the trigger unless the pump housing is compressed into the space.

31. The fastener driving tool of claim 30, wherein the cam pressably engages a lock out plate, the lock out plate having a rest position and a firing position, the pivot bracket pressing the lock out plate from the rest position to the firing position when the pump housing is compressed into the space, the lock out the plate preventing actuation of the trigger in the rest position and allowing actuation of the trigger in the firing position.

32. The fastener driving tool of claim 29, the tool further comprising a spark plug and a piezoelectric device; the piston housing comprising an accelerator plate; the accelerator plate comprising a disk radially oriented within the piston housing and an electrode; the accelerator plate being arranged and configured to divide the combustion chamber into a primary region and a secondary region and to direct ignited combustion gasses from the primary region into the secondary region of the combustion chamber; the electrode comprising an axially oriented pin; the pin being oriented toward the spark plug;

the trigger being coupled to the piezoelectric device and arranged and configured to activate the piezoelectric device; the piezoelectric device being arranged and configured to provide current to the spark plug; the spark plug being arranged and configured to ignite a fuel air mixture in the combustion chamber.

33. The fastener driving tool of claim 29, wherein the trigger is arranged and configured to activate an ignition circuit only after compressing the pump housing into the space and actuating the trigger.

34. A fastener driving tool operable through an internal combustion driven piston, the tool comprising:

(a) a driver body comprising a piston housing, a piston slidably housed in the piston housing, a driving member coupled to the piston; a combustion chamber defined by the body, piston housing, and piston; the piston and driving member being arranged and configured to drive a fastener upon combustion of a metered amount of gaseous fuel within the combustion chamber; the piston housing comprising an aluminum alloy; the piston comprising a self-lubricating compression ring;

(b) the piston housing comprising an accelerator plate; the accelerator plate comprising a slot and an electrode; the accelerator plate being arranged and configured to divide the combustion chamber into a primary region and a secondary region and to provide fluid communication between the primary and secondary regions;

(c) a pump system; the pump system comprising an intake system, an exhaust system, a pump sleeve, a pump housing, the piston housing, and a decompression port defined by the piston housing; the pump sleeve sealably contacting the piston housing and defining a space around the piston housing; the pump housing being arranged and configured to move axially in the space and to sealably contact the pump sleeve; a compression spring in the space axially biasing the pump housing; the intake system being arranged and configured for fluid communication with the combustion chamber and surroundings of the tool; the exhaust system being arranged and configured for fluid communication with the space and surroundings of the tool; the decompression port being arranged and configured to relieve pressure in the combustion chamber as the pump housing is compressed into the space;

(d) a fuel metering system comprising a port defined by the tool for receiving gaseous fuel, a regulator, and a shuttle valve in fluid communication with the port;

(e) the shuttle valve comprising a metering chamber housing, a metering chamber defined by the metering chamber housing and a gating valve; the metering chamber and gating valve being arranged and configured to provide asynchronous fluid communication between the metering chamber and the combustion chamber or between the metering chamber and the port; the combustion check valve arranged and configured for preventing fluid flow from the combustion chamber to the metering chamber; and (f) a linear cam system arranged and configured to actuate the gating valve for fluid communication between the port for fuel and the combustion chamber upon compression of the pump housing into the space.

* * * * *